US008382993B1

(12) United States Patent
Wisek et al.

(10) Patent No.: US 8,382,993 B1
(45) Date of Patent: Feb. 26, 2013

(54) DRAIN FILTER APPARATUS AND METHOD

(75) Inventors: Dennis E. Wisek, Huntley, IL (US); Kenneth T. Duffy, Sr., Wheaton, IL (US); Troy W. Livingston, Northbrook, IL (US)

(73) Assignee: Clear Drain Industries, LLC, Huntley, IL (US)

( * ) Notice: Subject to any disclaimer, the term of this patent is extended or adjusted under 35 U.S.C. 154(b) by 1513 days.

(21) Appl. No.: 11/900,075

(22) Filed: Sep. 7, 2007

Related U.S. Application Data

(63) Continuation-in-part of application No. 29/243,978, filed on Dec. 2, 2005, now Pat. No. 1,553,226.

(51) Int. Cl.

| | |
|---|---|
| ***B01D 35/02*** | (2006.01) |
| ***B01D 35/16*** | (2006.01) |
| ***E03C 1/282*** | (2006.01) |
| ***E03C 1/284*** | (2006.01) |

(52) U.S. Cl. ..... 210/767; 210/791; 210/153; 210/232; 210/236; 210/299; 210/310; 210/312; 210/447; 4/287; 4/292; 4/295; 4/679; 4/DIG. 9; 4/DIG. 14; 4/DIG. 19; 137/546; 137/547; 137/550; 137/247.11; 285/134.1

(58) Field of Classification Search ..... None
See application file for complete search history.

(56) References Cited

U.S. PATENT DOCUMENTS

| | | | | | |
|---|---|---|---|---|---|
| 278,045 | A | * | 5/1883 | Reich | 4/220 |
| 586,724 | A | * | 7/1897 | Edmonds | 210/447 |
| 594,169 | A | * | 11/1897 | Catsiff | 4/256.1 |
| 664,945 | A | * | 1/1901 | Guion | 4/652 |
| 861,493 | A | * | 7/1907 | Bell | 210/447 |
| 957,709 | A | * | 5/1910 | Phillips | 4/226.1 |
| 960,901 | A | * | 6/1910 | Hall | 210/232 |
| 965,836 | A | * | 7/1910 | Ray | 210/315 |
| 1,198,759 | A | * | 9/1916 | Pinder et al. | 137/247.51 |
| 1,217,763 | A | * | 2/1917 | Hirrich | 210/435 |
| 1,604,772 | A | | 1/1926 | Gillies | |
| 1,608,966 | A | * | 11/1926 | Tanaka | 210/299 |
| 1,798,441 | A | * | 3/1931 | Weiss | 210/435 |
| 1,817,376 | A | * | 8/1931 | Izquierdo | 210/447 |
| 1,884,855 | A | * | 10/1932 | Pryce | 137/247.51 |
| 2,166,279 | A | * | 7/1939 | Barwick | 210/94 |
| 2,246,012 | A | * | 6/1941 | Sanders | 210/163 |
| 2,472,322 | A | * | 6/1949 | Weissman | 210/163 |
| 2,512,394 | A | * | 6/1950 | Sullivan | 68/18 F |
| 2,552,744 | A | * | 5/1951 | Smith | 210/447 |
| 2,593,734 | A | * | 4/1952 | Davis | 137/247.51 |
| 2,652,152 | A | * | 9/1953 | Frankenhoff | 210/778 |
| 2,690,232 | A | * | 9/1954 | Brem | 210/450 |
| 2,742,101 | A | * | 4/1956 | Stambaugh | 137/247.41 |
| 3,372,807 | A | * | 3/1968 | Barnard | 210/94 |

(Continued)

*Primary Examiner* — Robert James Popovics
(74) *Attorney, Agent, or Firm* — James W. Potthast; Potthast & Associates

(57) ABSTRACT

A removable drain filter apparatus (20) with an housing (22) connectable with upstream and downstream drain pipes (40, 46) has a filtering chamber wider than the drain pipes and divided into an upstream portion (78) and a downstream portion (82) by a generally planer filter element (50). A hatch cover (32) carries a downwardly extending central core (76) with an O-ring seal (84), a filter securement member (86) for pressing the filter element (50) against an underlying support ledge (29) and a drain hole plug (88). The location of the O-ring (84) relative to the filter element (50) and the plug (88) being tapered enables the filter housing (22) to be drained of any water during removal of the hatch cover and before the watertight seal is broken to eliminate leakage of drain water out of the housing (22) when the hatch (31) is completely opened. The filter (50) bends out of the way of a plumber's auger (96).

56 Claims, 9 Drawing Sheets

U.S. PATENT DOCUMENTS 3,466,901 A * 9/1969 Reid ..... 68/18 F
3,556,298 A * 1/1971 Huebner et al. ..... 210/131
3,672,749 A * 6/1972 Roser ..... 359/894
3,681,562 A * 8/1972 Winzen ..... 210/94
3,788,484 A * 1/1974 Godin ..... 210/447
3,834,539 A * 9/1974 Thompson ..... 210/167.32
3,935,602 A * 2/1976 Kale ..... 4/292
3,954,116 A 5/1976 Guth et al.
3,994,031 A * 11/1976 Bishop ..... 4/679
4,031,914 A * 6/1977 Neri ..... 137/247.51
4,032,455 A * 6/1977 Kale ..... 210/435
4,045,351 A * 8/1977 Peterson ..... 210/238
4,051,042 A * 9/1977 Tullier et al. ..... 210/409
4,164,048 A * 8/1979 Kampfer et al. ..... 4/292
4,179,762 A * 12/1979 Barnhardt et al. ..... 4/679
4,199,827 A * 4/1980 Tuleja ..... 4/289
4,230,582 A * 10/1980 Tuleja ..... 210/311
4,301,554 A * 11/1981 Wojcicki ..... 4/679
4,340,470 A * 7/1982 Van Mol ..... 210/94
4,376,053 A * 3/1983 Bullock et al. ..... 210/767
4,385,891 A * 5/1983 Ligotti ..... 433/92
4,539,718 A * 9/1985 Haer ..... 4/292
D280,925 S * 10/1985 Farnen ..... D23/268
4,555,820 A 12/1985 Dragstrem
4,700,412 A * 10/1987 Manuel ..... 4/679
4,702,828 A 10/1987 Mehmert et al.
4,741,083 A 5/1988 Wolfe
4,949,406 A * 8/1990 Canelli ..... 4/679
4,999,858 A * 3/1991 Wu ..... 4/288
5,005,806 A 4/1991 Krauth
5,030,279 A 7/1991 Krauth
5,038,816 A * 8/1991 Weltsch ..... 137/247.51
5,052,491 A 10/1991 Harms et al.
5,058,214 A * 10/1991 Shinn ..... 4/679
5,075,905 A * 12/1991 Rutherford ..... 137/247.51
5,095,553 A * 3/1992 Vosper ..... 4/679
5,159,724 A * 11/1992 Vosper ..... 4/679
5,241,979 A * 9/1993 Chang ..... 137/247.41
5,255,402 A * 10/1993 Kashani ..... 4/679
5,267,361 A * 12/1993 Lai ..... 4/679
5,300,221 A 4/1994 Austevoll
5,372,718 A * 12/1994 Zebian ..... 210/301
5,382,360 A * 1/1995 Vosper ..... 210/239
5,522,229 A * 6/1996 Stuchlik et al. ..... 62/127
5,525,215 A * 6/1996 Marchionda ..... 210/95
5,546,614 A * 8/1996 King, II ..... 4/256.1
5,638,557 A * 6/1997 Iida et al. ..... 4/679
5,715,550 A * 2/1998 Griffin ..... 4/679
6,153,095 A * 11/2000 Francisco ..... 210/153
6,308,350 B1 * 10/2001 Marchionda ..... 4/679
6,315,896 B1 * 11/2001 Johnson ..... 210/164
6,387,261 B1 5/2002 Mojena
6,406,622 B1 6/2002 Tsuihiji et al.
6,428,692 B2 8/2002 Happel
6,487,729 B2 * 12/2002 Delanzo ..... 4/286
6,487,730 B2 12/2002 Pardo et al.
6,594,831 B1 7/2003 Pardo et al.
6,915,814 B2 * 7/2005 Cheng ..... 137/247.51
7,128,834 B2 * 10/2006 Davenport ..... 210/236
D553,226 S * 10/2007 Wisek ..... D23/268
7,531,088 B2 * 5/2009 Gurmu ..... 210/153
7,618,532 B2 * 11/2009 Worth ..... 210/164
7,725,960 B2 * 6/2010 Markaj ..... 4/289
7,780,013 B1 * 8/2010 Kern ..... 210/435
7,799,216 B2 * 9/2010 Gurmu ..... 210/153
7,854,852 B1 * 12/2010 Reavis ..... 210/767
7,861,329 B2 * 1/2011 Markaj ..... 4/289
7,887,697 B2 * 2/2011 Worth ..... 210/164
8,088,079 B2 * 1/2012 Kaye et al. ..... 600/562
2002/0050473 A1 * 5/2002 Davenport ..... 210/447
2002/0144338 A1 * 10/2002 Delanzo ..... 4/286
2003/0163869 A1 * 9/2003 Bosch ..... 4/679
2004/0040597 A1 * 3/2004 Cheng ..... 137/247.51
2004/0144703 A1 * 7/2004 Davenport ..... 210/153
2007/0191731 A1 * 8/2007 Kaye et al. ..... 600/562
2007/0262006 A1 * 11/2007 Worth ..... 210/164
2008/0053881 A1 * 3/2008 Gurmu ..... 210/162
2008/0216221 A1 * 9/2008 Markaj ..... 4/289
2009/0026285 A1 * 1/2009 Worth ..... 239/57
2009/0045125 A1 * 2/2009 Gurmu ..... 210/305
2010/0236645 A1 * 9/2010 Markaj ..... 137/545
2011/0145989 A1 * 6/2011 Jan ..... 4/679
2012/0222996 A1 * 9/2012 Rennels ..... 210/163
2012/0266372 A1 * 10/2012 Epstein et al. ..... 4/290
2012/0266982 A1 * 10/2012 Worth et al. ..... 137/544
2012/0267296 A1 * 10/2012 Epstein et al. ..... 210/163

* cited by examiner

DRAIN FILTER APPARATUS AND METHOD

CROSS-REFERENCE TO RELATED APPLICATIONS

This application is a continuation-in-part of, and claims the benefit under 35 U.S.C. 120 of application number 29/243,978 of Dennis E. Wisek, one of the co-inventors herein, filed Dec. 2, 2005 now U.S. Pat. No. D,553,226 and entitled "Sink Trap Collection Device", which is hereby incorporated by reference.

BACKGROUND OF THE INVENTION

1. Field of the Invention

This invention generally relates to drain sink filters and, more particularly, to drain sink filters with filter elements that are removable for cleaning or replacing and methods of drain filtering.

2. Discussion of the Prior Art

Conventional sink drainage systems are notorious for becoming clogged as evidence by all of the chemical drain cleaners on the market. Such chemical drain cleaners are caustic and can be harmful to not only the plumbing but also to the user should cleaning material splash onto the skin or eyes of the user. In addition, such cleaners are harmful to the environment and fish and other aquatic plant and animal life.

Mechanical systems are available for unplugging clogged drains such as use of the well known pipe auger, or "plumber's snake", a rubber plunger or a source of pressurized air applied from the sink drain. It is also known to provide access to the pipes beneath the sink drain for the application of pressurized water or air.

With a removable drain filter, a filter is mounted within a watertight housing that is connected inline with the drainage pipes beneath the sink drain. The clog forms in the filter and not in the pipes so that it may be easily removed simply by removing the filter from the filter housing, cleaning the filter element and then returning the filter to the filter housing. Such a filter also has the advantage of catching items that are inadvertently dropped down the sink drain, such as jewelry, contact lenses, etc. for easy recovery, instead of being irretrievably lost down the drainage system.

In one known removable filter, the filter is mounted only within the drain pipe via a radially outwardly facing opening in the pipe through which the filter element is laterally inserted. Unfortunately, the opening is located at the low spot in a U-shaped, P-trap, and when the filter element is removed from within its mounting hole at the bottom of the trap, any water accumulated above the clog immediately leaks out of the mounting hole. Also, disadvantageously, the size of the filter is strictly limited to the size of the drain pipe.

It is also known to provide a removable filter within a lateral section of a T-shaped pipe, but disadvantageously, the inventors have noted that the access opening needed to remove these filters face laterally outwardly. Once the filter becomes clogged there is no way to drain the filter housing. Consequently, when the housing is opened to remove the filter, any water within the lateral section immediately leaks out of the filter housing.

Another problem noted by the inventors with known inline drain filtering apparatus is that the filters are non-planer and configured and mounted in such a way that in the event of a clog occurring downstream of the filter hosing, the filter must be removed from the filter housing, whether clogged or not, in order to clear the clog. Only after the filter housing is fully opened and the filter is removed from the filter housing, may an unclogging tool, pressurized water, or pressurized air moved through the empty filter housing to clear the downstream clog.

Yet another problem with all known filtering apparatus is that the housings for the filters and thus the filters themselves are limited in width to the relatively narrow width of the drain pipes to which they are attached. This disadvantageously severely limits the size of the total filtering area of the filter.

Accordingly, there is a need to provide a drain filter apparatus that overcomes these difficulties and others that the inventors have discerned.

SUMMARY OF THE INVENTION

Accordingly, the principal object of the present invention is to provide a drain filter apparatus and method of filtering with a drain filter apparatus that overcome the problems of the know drain filtering devices noted above for preventing or unplugging clogged drains.

This objective is achieved in part by providing a drain filter apparatus with a filter housing with a watertight filtering chamber having a forward, cylindrical section and a relatively wider and larger aft section extending laterally outwardly from the forward cylindrical section and having a top and a bottom, means for connecting an upstream drain pipe to the top of the forward cylindrical section of the watertight filtering chamber, means for connecting a downstream drain pipe to the bottom of bottom of the forward cylindrical section of the filter housing, and a filter element mounted at an intermediate location within the chamber and extending coextensively with both the forward section and aft section of the filtering chamber and sealed against interior walls of the filtering chamber to divide the chamber into an upstream part above the filter element and a downstream part beneath the filter element, said filter element having a generally planer filter body with a forward, relatively narrow, primary filtering portion within the forward cylindrical section and located directly beneath the upstream drain pipe connecting means, and an aft, relatively wider, secondary filtering portion within the aft section of the filtering chamber and extending laterally outwardly from the relatively narrow primary filtering portion with a width and a cross-sectional area that is substantially larger than the diameter and cross-sectional area of the forward portion of the filter element, of the forward section of the cylindrical filtering section and of the upstream drain pipe.

The objective is also achieved in part by provision of a drain filter apparatus having a filter housing with a watertight filtering chamber, a filter element mounted within the watertight filtering chamber having a plurality of filtering openings through which drain water may pass, a drain hole, and an access hatch in the chamber for access to the filter element for removal and installation of the filter element, and a removable watertight hatch cover for closing the access hatch opening.

Preferably the drain hole is substantially larger than the plurality of filtering holes and the drain filter apparatus includes a drain hole closure member that closes the drain hole when the hatch cover is in a fully closed position, and that is removed at least partly from the drain hole when the hatch cover is in less than a fully closed position but which is still watertight.

In the preferred embodiment, the drain hole closure member includes a plug that extends downwardly from an underside of the hatch cover that is received within and fills the drain hole when hatch cover is fully closed, and that is at least partly removed from the drain hole when the hatch cover is moved to a position less than fully closed. The watertight cover has a watertight seal that is positioned relative to the drain hole and the plug to remain in watertight sealed contact with the access hatch until after the plug is at least partly removed from the drain hole to allow the filtering chamber to drain. The hatch cover includes a hatch cover body with a cylindrical wall with internal threads, a downwardly extending closure member with an upper cylindrical section that is concentric with and spaced radially inwardly from the cylindrical wall and has a groove within which is mounted a resilient seal, and a lower, section with a bottom with a periphery and carrying a drain hole plug at a central inner location extending downwardly from the bottom and spaced from a periphery of the bottom to define a shoulder, said shoulder pressing down on the filter element when the plug fills the filter drain hole.

Achievement of the object of the invention is also acquired by providing a drain filter apparatus with a watertight housing having an inline section with an inlet and an outlet at opposite ends for connection with an upstream drain pipe and a downstream drain pipe, respectively, a lateral section in fluid communication with, and laterally extending outwardly from, the inline section, a filter element mounted within the housing to enable movement of a distal end portion of the filter element between a fully blocking position between the inlet and the outlet, and another position in which a part of the filter element is moved away from a fully blocking position to allow passage of an unclogging tool between the inlet and the outlet. Preferably, the filter element has a peripheral wall with a pair of inwardly extending notches on opposite sides of the of the filter element to facilitate bending of the filter element along a line extending between the inwardly extending notches. The filter element has an aft portion located opposite the distal end portion with opposite sides that are supported by a pair of underlying members with forward ends that are spaced from the distal end portion, and the distal end portion is cantilever mounted with no underlying support to enable it to be bent downwardly relative to the distal portion during tools insertion.

The object of the invention is also partly obtained by provision of a drain filter apparatus composed of a filter housing with a filtering chamber and an access opening to the filtering chamber, a releasably mounted filter element with a surface resting on an underlying filter support member within the filtering chamber, and a removable cover for closing the access opening, said cover carrying a filter securement member that extends inwardly from the access opening into the chamber and engages a surface of the filter element opposite to said one surface when in a fully closed position, said filter element being held in place between the support member and the securement member.

In addition, the objective of the invention is achieved by providing a drain filter apparatus, having a filter housing with a watertight filtering chamber, a filter element with a preselected filtering area releasably mounted at an intermediated location within the chamber and dividing the chamber into an upstream part having a top and a downstream part with a bottom, means for connecting an upstream drain pipe to the upstream part of the chamber, means for connecting a downstream drain pipe to the downstream part of the chamber, and a closable access hatch for access to the filter element for removal and installation of the filter element, said closable access hatch being located only in the top of the upstream part of the filtering chamber and facing upwardly to reduce spillage when the access hatch is opened.

Moreover, the object of the invention is acquired by providing a drain filter apparatus, with a filter housing with a filtering chamber, an inlet, an outlet and connectors for connecting the inlet and the outlet to upstream and downstream drain pipes, respectively, a filter body within the chamber in filtering relationship between the inlet and outlet with a plurality of relatively small filtering holes for passage of water to be filtered during filtering, a drain hole substantially larger than any of the relatively small filtering holes.

Also, the object of the invention is gained by providing a drain filter apparatus, with a filter housing with a filtering chamber, an inlet, an outlet and connectors for connecting the inlet and the outlet to upstream and downstream drain pipes, respectively, a filter element contained within the housing and having a primary filtering section with a concave portion with a plurality of filtering holes and a periphery partly shaped to conform to an interior of a drain pipe conforming surface of the filtering chamber extending between the drain pipes, and an aft, substantially planer and relatively larger secondary filtering section with a plurality of filtering holes extending from the primary filtering section for filtering after the forward section becomes clogged.

The objective is also achieved by providing a filter apparatus, with a filter housing with a filtering chamber, an inlet, an outlet and connectors for connecting the inlet and the outlet to upstream and downstream drain pipes, and a filter element contained within the housing and having a generally planer filter body with a plurality of filtering holes with a forward section and an aft section, a pre-weakened area of the filter body to facilitate relative bending between the forward section and the aft section. Preferably, an upstanding peripheral wall surrounding at least part of the forward section, and a pre-weakened area is formed by a pair of notches in the in the upstanding peripheral wall.

The object of the invention is also achieved partly by providing a method of filtering drain liquid with a drain filter apparatus by performance of the steps of connecting a filter housing with a watertight filtering chamber between a pair of drain pipes, installing a filter element with a plurality of filtering holes within the watertight filtering chamber by inserting the filter element through an access hatch in the chamber, closing the hatch with a removable watertight hatch cover for closing the access hatch opening, passing liquid from one of the drain pipes through the filter element until the filter element becomes clogged, draining any water collected above the filter element through a drain hole that bypasses the plurality of filtering holes while the hatch is still at least partly closed, removing the hatch cover after the filtering chamber has been drained through, and replacing the clogged filter element with a clean filter element installed into the filtering chamber, re-closing the hatch to resume filtering with the clean filter element.

Preferably, included is the steps of closing the drain hole during normal filtering operations when the hatch is closed and opening the drain hole during opening of the hatch cover when the hatch is at least partly closed. Closing is preferably performed by filling the drain hole with a tapered plug carried by the hatch cover. A watertight seal with a seal that is positioned relative to the drain hole and the closure member to remain in watertight sealed contact with the access hatch until after the closure member is at least partly removed from the drain hole to allow the filtering chamber to drain.

The object of the invention is also secured in part by providing a method of filtering with a filter apparatus by performing the steps of connecting an inlet and an outlet at opposite ends of an inline section of a watertight housing with an upstream drain pipe and a downstream drain pipe, respectively, said housing having an inline section in fluid communication with the inline section and another section laterally extending outwardly from the inline section, mounting a filter element within the housing to enable movement of a distal end portion of the filter element between a fully blocking position between the inlet and the outlet and another position in which a part of the filter element is moved away from a fully blocking position, after the filter element is moved from a blocking position, passing an unclogging tool between the inlet and the outlet to clear a clog located downstream of the housing.

Preferably, the step of moving the distal end portion includes the step of either (a) bending the distal portion downwardly with the unclogging tool, or (b) sliding the filter away from a blocking position. In the preferred embodiment, also are included the steps of holding the distal end portion out of a fully blocking position with a side of the unclogging tool after the tool has been fully passed between the inlet and the outlet, removing the unclogging tool, resiliently returning the distal end portion of the filter element to the fully blocking position after the tool has been removed.

BRIEF DESCRIPTION OF THE DRAWINGS

The foregoing advantageous features and objects of the drain filter apparatus and method of the present invention will be described in detail and further features, advantages and objectives will be made apparent from the detailed description below that is given with reference to the several figures of the drawing in which.

DETAILED DESCRIPTION

Figure 1:
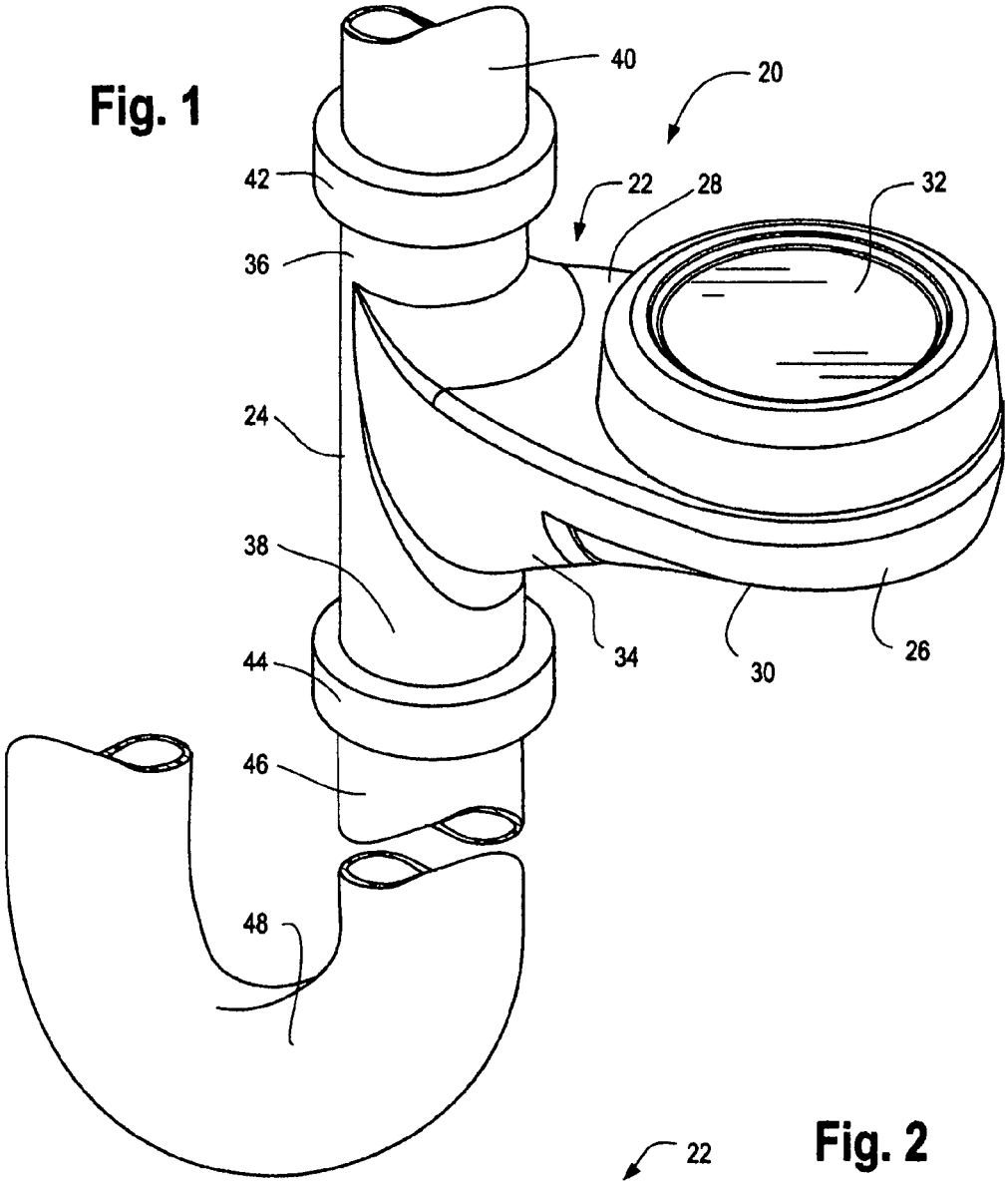
FIG. 1 is a perspective view of a preferred embodiment of the removable drain filter apparatus of present invention as attached between a drain pipe and a P-trap of a drainage system.
Figure 2:
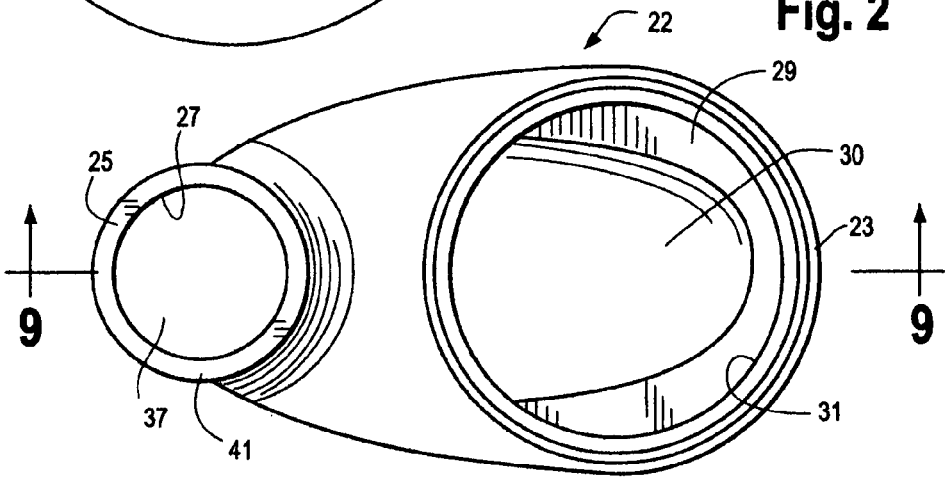
FIG. 2 is a plan view of the removable drain filter assembly of FIG. 1 with the filter access hatch cover and the upper drain pipe removed.
Figure 3:
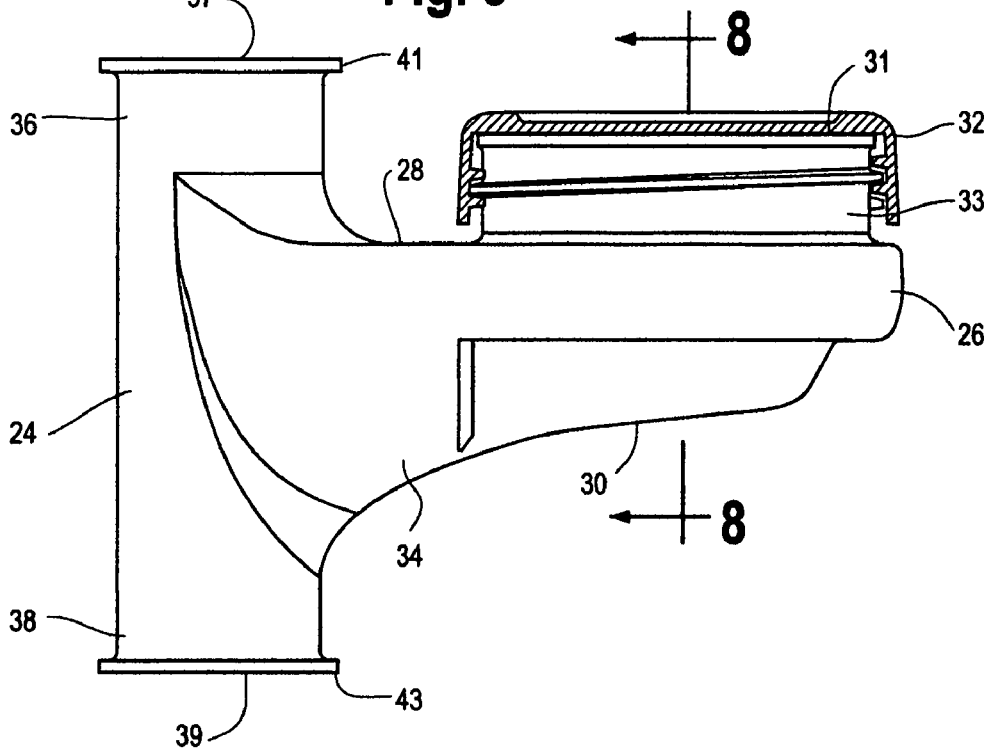
FIG. 3 is a side view of the removable drain filter apparatus of FIG. 2.
Figure 4:
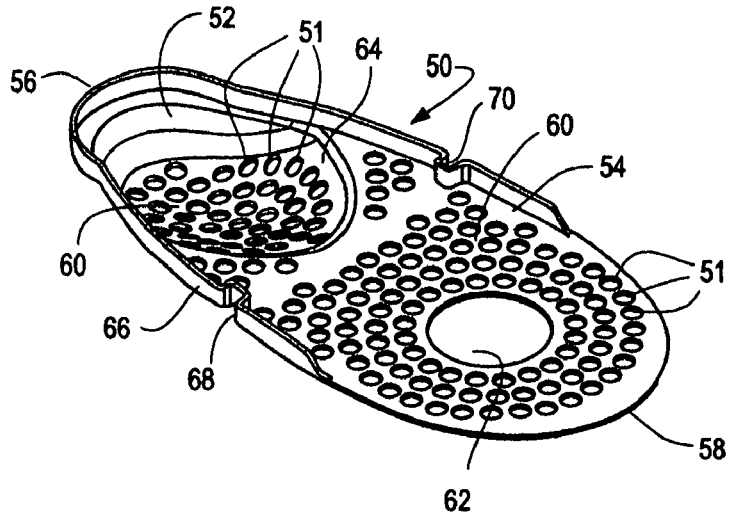
FIG. 4 is a perspective view of a preferred embodiment of the removable filter element that is contained within the removable drain filter assembly of FIGS. 1-3.
Figure 5:
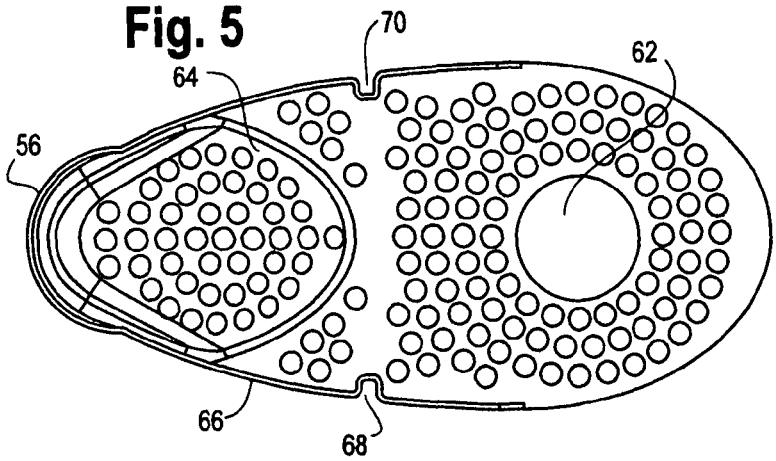
FIG. 5 is a plan view of the filter element of FIG. 4.

Referring to FIGS. 1-3, a preferred embodiment of the drain pipe filter apparatus 20 of the present invention has a relatively thin-walled, hollow housing 22 with a cylindrical, tubular, forward housing section 24 and a relatively wider and larger aft housing section 26 extending laterally, preferably radially, outwardly from the forward, inline, cylindrical housing section 24. As viewed from the top in FIG. 2, the housing 22 has a generally oval shape but with a relatively wide aft rounded end 23 and a relatively narrow forward rounded end 25 that generally conforms to and merges with a cylindrical wall 27 of the forward housing section 24. The interior of the aft housing has a generally U-shaped inwardly extending filter support member 29 for supporting the sides of aft end portion of a filter 50, described below with reference to FIGS. 4-7. However, in order to achieve one objective of the invention, as best seen in FIG. 2, the interior of cylindrical wall 27 of the forward section 24 is clear of a filter support ledge or any other obstruction that would interfere with movement of the filter element 50 surrounded by wall 27. The absence of obstructions also facilitates smooth laminar flow of waste water and insertion of an unclogging tool through the inline housing section 24.

Preferably, the forward housing section 24 and aft housing section 26 are integrally formed together of a single piece of material that is relatively rigid, durable, water-impervious and caustic chemical-impervious. This material is a plastic such as polyethylene or polypropylene, such as 9012High Density Polyethylene. The aft housing 26 has a top wall 28 and a bottom wall 30. The top 28 has an upwardly facing, circular access hatch opening, or hatch, 31, seen in FIGS. 2 and 3, which is closed by a generally cylindrical hatch cover 32, shown in FIG. 1.

The hatch opening 31 is at the top of, and is surrounded by, a threaded cylindrical collar 33 that is elevated above the top 28 to reduce the risk of spillage when the hatch cover 32 is removed. Also, the collar 33 provides means for releasably, threadably attaching the hatch cover 32 to the aft housing section 26 and provides an elongate interior sealing surface.

As best seen in FIG. 3, the bottom wall 30 of the aft housing has a relatively level aft part directly beneath the hatch cover 32 that slants inwardly, and slightly downwardly to merge with a throat-like part 34 near the forward housing section 24. The throat-like part 34 extends inwardly and relatively more steeply downwardly from the more level part of the bottom 30 to merge with opposite sides of the cylindrical wall of the forward housing section 24 at a level substantially lower than the aft part of the bottom 30. This insures rapid, non-turbulent draining from directly beneath the hatch to the forward housing section 24 and then out of the housing 22 and down the drain pipe 46. The throat-like part 34 also creates a space beneath the filter to accommodate downward movement of a filter element, as will be explained below.

The forward, cylindrical housing section 24 has an upper, upstream, inlet end 36 and a lower, downstream outlet end 38. The inlet end 36 has a circular inlet 37 that is connected inline with the bottom outlet open end of an upstream drain pipe 40 by means of a suitable pipe connector 42. The outlet end 38 has a circular outlet 39 that is connected inline with the top inlet end of a downstream drain pipe 46 by another suitable inline pipe connector 44 substantially identical to the connector 42. The inlet end 36 has an annular coupling flange 41 that cooperates with the connector 42, and the outlet end 38 has an identical annular coupling flange 43 that cooperates with the connector 44. The top of the downstream drain pipe 46 may be, but is not necessarily, the upper, inlet end of an upturned P-trap 48. If such a P-trap 48 is present, then the drain filter apparatus 20 is mounted upstream of the P-trap. In the event of a sink with a drain plug opener mechanism contained within the drain pipe immediately beneath a sink (not shown), the drain filter apparatus 20 is mounted to the drainage system beneath the drain plug opener mechanism.

Referring to FIGS. 4-7, the filter element 50 is of a generally oval shape with a generally, thin-walled, planer body with a forward, relatively narrow, primary filtering portion 52 and an aft, relatively wider, secondary filtering portion 54. Both the primary and secondary filtering portions have a plurality of filtering holes 51 distributed as shown. Waste water passes though the filtering holes 51 while solid material larger than the filter holes 51 are trapped behind on parts 60 of the top surface of the filter body located between the filtering holes 51. The filtering holes 51 are preferably one eighth inch in diameter and many of the parts 60 between them are generally substantially less although there are also larger interstitial parts. However, it should be appreciated that filtering holes 51 of other sizes and different arrangements or numbers could be successfully employed.

The primary filtering portion 52 has a relatively small circular end 56 that is contoured to fit snuggly against the interior of the cylindrical end wall 27, FIG. 2, of the forward cylindrical housing section 24 directly between the inlet end 37 and the outlet end 39 and between their associated drain pipe connectors 42 and 44, respectively. The aft portion 54 of the body expands gradually outwardly from the relatively narrow end 56 as it laterally extends outwardly toward, and merges with, an aft arcuate end 58 that is substantially wider than the diameter of circular end 56.

Because of the substantially increased relative wideness of the aft portion 54 of the filter element 50, the aft portion 54 has a secondary filtering area that is substantially larger than the primary filter area 52 directly between the drain pipes 36 and 38 without extending excessively laterally outwardly. The filter element of FIG. 4 preferably has a maximum width of approximately 2.1 inches while the internal diameter of the cylindrical forward housing section 24 is approximately only 1.12 inches. This approximately two to one ratio can be easily increased without increasing the total length of approximately 4.46 inches if greater filtering area is needed. However, it is believed that a filter element 50 of this approximate dimension will provide enough filtering area to enable reasonably long periods between times when it becomes necessary to clean the filter without excessively extending radially outwardly from the drain pipes 40 and 46. Preferably, the filtering area is at least three times larger than the cross-section of the drain pipes 40 and 46 although larger filtering areas are possible because of the ability of providing the filter element 50 with a an even greater width than indicated above.

However, it should be appreciated that the width of the filter element 50 could be increased even further to provide even greater filtering area without the need to make the filter body any longer than the length indicated above. The length could also be increased but it is believed that excessive length can lead to mounting space difficulties more so than can increased width. In any event a significant object of the present invention is achieved by provision of a filter body with a laterally extending aft portion 54 with both a width and a cross-sectional area that is substantially respectively larger than the diameter and cross-sectional area of the forward portion of the filter element, of the forward section of the cylindrical filtering section 24 and of both of the drain pipes 40 and 46.

In addition, the aft filter housing top 28, because it is correspondingly wide to accommodate the greater width of the filter element 50, it is also sufficiently wide to accommodate a filter access hatch 31 having a width and cross sectional area substantially larger than that of the upstream drain pipe 40 to enable removal of the filter element 50 though the access hatch 31 without substantial distortion of the filter element 50.

Located in the aft portion 54 of the filter element is a drain hole 62 that is substantially larger than the plurality of drain holes 51. When the filter element 50 is operatively mounted within the housing 22, the center of the drain hole 62 is located immediately beneath the center of the circular hatch 31 and hatch cover 32.

Figure 6:
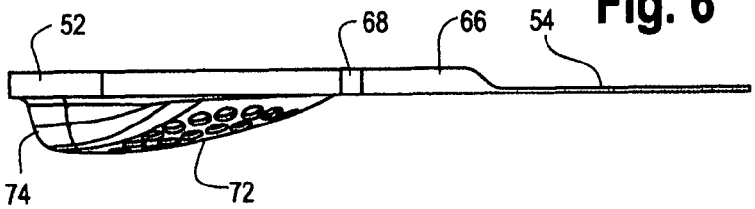
FIG. 6 is a side view of the filter element of FIGS. 4 and 5.
Figure 7:
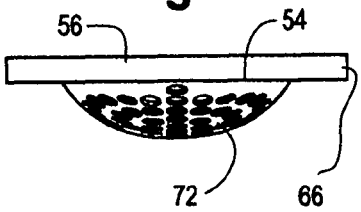
FIG. 7 is a front view of the removable filter element of FIGS. 4-6.

The drain hole 62 performs a dual function. First, it is kept closed and clean of debris during the filtering process by means of a mating plug 88, FIG. 8, carried by the hatch cover 32, but is used to drain the housing 22 after the filter element 50 becomes clogged. Second, the drain hole 62 provides a finger handle through which someone may hook their finger to pull the filter element 50 up and out of the access hatch 31 after the hatch cover 32 is removed As best seen in FIGS. 6 and 7, although the filter 50 is substantially planer the primary filtering portion 52 has a slightly concave portion 64 with a plurality of filtering holes 51 located only generally intermediate the drain pipe connectors 42 and 44. Because the filter body is substantially flat, particularly the aft portion 54, the body of the filter element 50 is relatively flexible compared to the housing 22 and the drain pipes and is bendable. The flexibility facilitates the removal and insertion of the filter element 50 thought the hatch 31. Also, because the filter element 50 is bendable it may be bent out of the way of the drain pipes with an unclogging tool 96, FIG. 11, as will be explained in greater detail below.

The forward part 56 is the primary, forward, filtering portion 52. Because of its location directly intermediate the drain pipes 40 and 46 and because of its concavity, the forward filtering portion 52 tends to retain water rather than to have it spread outwardly over the flat filtering area of the aft filtering portion 54 until after the concavity fills with debris. After the concavity fills with debris and becomes clogged, water spreads over the larger secondary, aft, filtering portion 54 for further filtering. Advantageously, the filter tends to collect the thickest concentration of debris away from the aft end 58 of the filter 50 and the drain hole 62 that is used to pull the filter element 50 out of the housing 22 to facilitate removal of the filter 50.

Although bendable when a sufficient force is applied, it is also necessary that the filter element 50 not significantly flex or bend during the normal filtering process. Accordingly, the forward portion 52 and a forward part of the aft portion 54 are provided with a peripheral wall 66 with a rounded circular section at the relatively narrow round end 56 that is pressed against the inside of the cylindrical wall 27, FIG. 2, of the cylindrical housing section 24. As noted above, the forward, inline, filtering portion 52 of the filter 50 that engages the cylindrical wall 27 has no underlying support that would prevent the forward portion 52 of the filter element 50 from being bent downwardly relative to the aft part 54. Instead, the wall 66 provides the forward filtering portion 52 with increased rigidity relative to the flat aft portion 54. Advantageously, the increased rigidity provided by the wall 66 enables cantilever mounting of the forward filtering portion 52 with sufficient structural integrity to maintain a horizontal orientation during normal filtering operations including those times when the forward filtering portion 52 becomes weighted with filtered debris.

On the other hand, the flat, peripheral edge of the aft portion 54 that is without any part of the wall 66 does not need increased structural integrity because downward movement is precluded by the underlying support member, or ledge, 29. Also, relative upward movement or bending movement of the filter element 50 off the underlying mounting member, or filter support ledge, 29 is prevented. The wall-less peripheral edge of this aft portion 54 of the filter 50 is tightly squeezed between the support ledge 29 and another shoulder member 86, FIG. 8, carried by the underside of the hatch cover 32 when the hatch cover 32 is fully closed. Thus, the needed rigidity is provided by the mounting arrangement, itself, which reinforces the edge of the aft portion 54 that is not reinforced by the wall 68.

Figure 11:
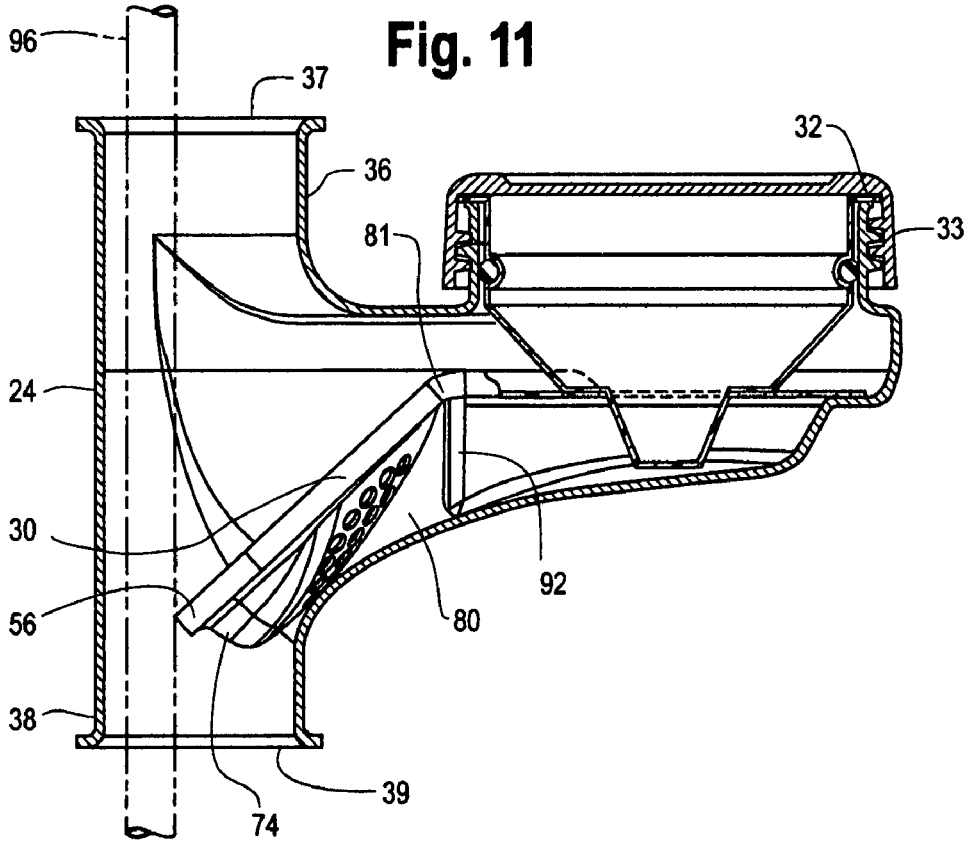
FIG. 11 is a sectional side view similar to that of FIG. 9 with the hatch cover closed and illustrating the bending of an inline section of the removable drain filter apparatus to enable the passage of a plumbers snake or other like tool through the drain pipes and the inline portion of the removable drain filter apparatus to clear a clog beneath the filter element.

The peripheral wall 66 has a pair of inwardly extending notches 68 and 70 on opposite sides of the of the filter element 50 to facilitate bending of the filter element 50 by the force of an unclogging tool 96, FIG. 11, generally along a straight line extending between the inwardly extending notches 68 and 70. The notches 68 and 70 function somewhat as hinge-pins to define a pivot axis extending between the notches 68 and 70. As seen best in FIG. 7, the depth of the concave section 64 is relatively shallow with a gradually downwardly, forwardly sloping section 72 joined to a more rapidly rising, forwardly slanted wall 74. Because of the shallowness of the concavity and this note configuration, it is easy for the end of the unclogging tool 96 to push the primary filter portion 52 downwardly and then to slide out of the concavity and past the distal end 56 and ultimately out of the end of outlet end 38.

Figure 8:
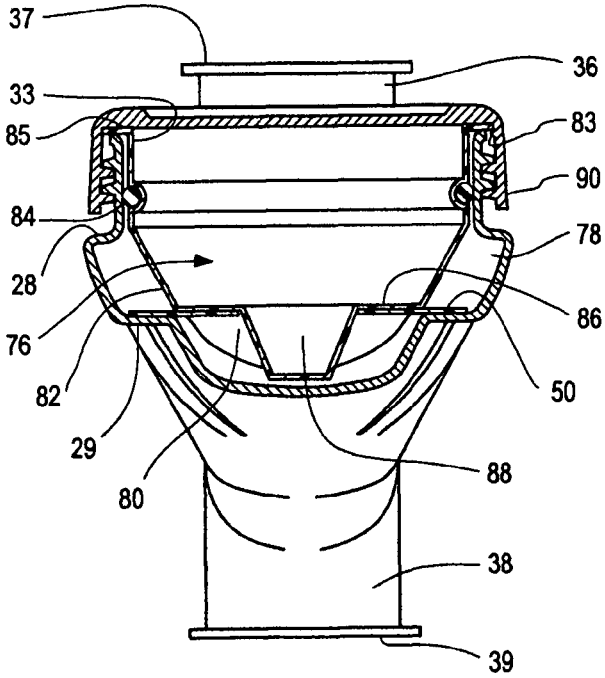
FIG. 8 is sectional end view of the removable drain filter apparatus taken along a section line 8-8 of FIG. 3 showing a side sectional view of the drain filter apparatus of FIGS. 1-7.
Figure 9:
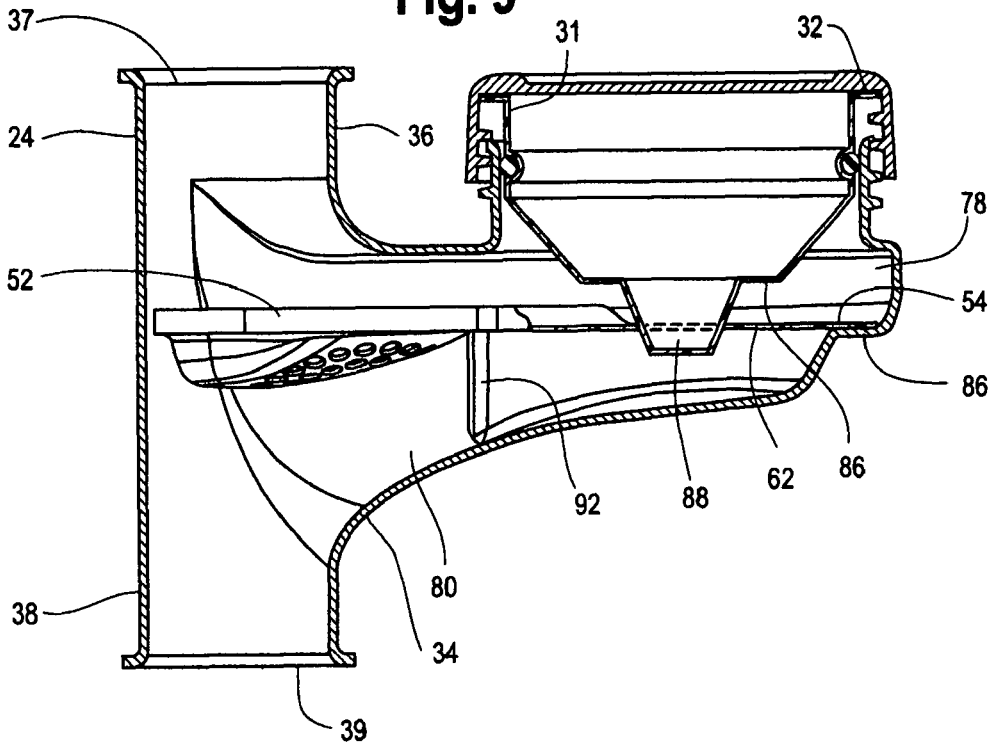
FIG. 9 is a sectional side view of the removable drain filter apparatus taken along section line 9-9 of FIG. 2 but with the filter element mounted within the housing and positioned horizontally in operative position and the hatch cover partly closed.

Referring to FIGS. 8 and 9, the filter element 50 is seen as mounted at an intermediate location within a filtering chamber 76 within the housing 22. The filter 50 laterally fills the middle of the chamber 76, extending coextensively with both the forward section 24 and the aft section 26. The edges of the filter element 50 are pressed against the interior walls of the filtering chamber 76 to divide the chamber into an upstream part 78 above the filter element 50 and a downstream part 80 beneath the filter element 50. The upstream drain pipe 40 and inlet 37 are connected to the upstream part 78 and the downstream drain pipe 46 and outlet 39 are connected to the downstream part 80.

The hatch cover 32 has a downwardly extending, centrally and inwardly located, center-line symmetrical, filter securement member 82. The filter securement member is made from hollow resilient plastic, and has an outwardly extending connection collar 85 that is received and held against the underside of the hatch cover 32 by a plurality of inwardly extending snap-fit tab connectors 83. The tabs are preferably integrally formed with the hatch cover 32 and are spaced beneath the underside of the hatch cover 32 by a distance approximately equal to the thickness of the connection collar 85.

The securement member 82 has an upper cylindrical section with a circular groove within which is mounted a resilient O-ring seal 84. The seal 84 is pressed against a smooth interior cylindrical surface of the upstanding collar 33 to create a water-tight seal. It should be appreciated that the invention can be successfully employed with a different type of resilient or non-resilient seal that is watertight either on the interior or the exterior of the collar 33. Beneath the upper cylindrical section is an inwardly, downwardly tapered, truncated, conical section that terminates at its bottom at a horizontal annular shoulder 86. From the center of the annular shoulder, downwardly extends an inwardly, downwardly tapered truncated conical plug 88. The plug 88 is received within the drain hole in the filter element when the hatch cover 32 is in a fully closed position, as shown in FIG. 8, to plug closed the drain hole 62 during normal filtering operation.

In accordance with the preferred embodiment of the invention, leakage when removing the hatch cover 32 for removal of the filter element 50 is eliminated or substantially reduced. The inwardly tapered configuration of the plug 88 facilitates a snug fit with the drain hole 62 and, together with the relatively narrow bottom, acts to guide the plug 88 into full insertion into the drain hole 62. However, as seen in FIG. 9, because of the tapered configuration of the plug 88, when the hatch cover 32 is in less than a fully closed position, the sides of the plug 88 become spaced from the interior sides of the drain hole 62. Also, the shoulder 86 becomes spaced from the top of the filter element 50 and around the drain hole 62 to allow any water accumulated within the upstream part 78 of the filtering chamber to drain out of the drain hole 62.

This draining preferably occurs before the hatch cover is fully removed and preferably before the seal provide by the O-ring seal 84 is broken. Because of the length of the upraised collar 33 and the position of the O-ring seal 84 relatively low on the cylindrical section of the securement member 82 to engage the collar 33 near the bottom of the collar 33, when the hatch cover is less than fully closed, but is not yet fully open, the O-ring seal 84 still maintains a watertight seal after the plug 88 is no longer fully inserted into the drain hole 62, as shown in FIG. 9. Thus, the water drains out of the housing 22 before the water-tight seal provided by the O-ring 84 is broken to reduce any leakage of waste water out of the hatch 31 when the hatch cover 32 is fully removed from the collar 33 to remove the filter element.

Of course, even in the absence of the O-ring seal, because of the access hatch facing upwardly and being elevated above the filter element 50 at the top of the cylindrical collar 33, spillage may be prevented or substantially reduced due to the unplugging of the drain hole 62 before the threaded connection between the hatch cover 32 and the collar 33 is separated. In addition, the hatch cover 26 is provided with a downwardly extending, cylindrical skirt 90 to which the collar 33 is threadably attached which also reduces the risk of leakage while the collar 33 and the skirt 90 remain attached.

As briefly noted above, in addition to closing any gaps between the plug 88 and the drain hole 62, the annular shoulder 86 presses the filter element 50 downwardly. The edge of the aft portion of the filter element 50 surrounding the round end 23 and extending on both sides to the forward ends 92, FIG. 9, of the support ledge 29, rests upon, and is provided underlying support by, the horseshoe-shaped ledge 29. When the filter element 50 is pressed downwardly by the shoulder 86, the edges of the filter 50, in turn, press against the support ledge 29. The filter element is thus, in effect, squeezed and held in place between the support ledge 29 and the shoulder 86.

Although use of the plug 88 is preferred, alternatively, in the absence of the plug 88, the shoulder 86 would become a circular flat bottom surface that would both hold down the filter 50 around the periphery of the drain hole 62 and also close the drain hole 62. In any event, the aft portion 54 of the filter element 50 is held in place against vertical movement relative to the support ledge 29 by being held between the support 29 and the securement member 82. On the other hand, the engagement of the edges of the filter element 50 with the inside surfaces of the housing 22 and the snug insertion of the plug 88 within the drain hole 62 blocks the filter element 50 against relative lateral or horizontal movement within the housing.

Only the aft portion 54 of the filter element 50 is secured with underlying support in the aft section 26 of the housing 22, while the forward portion 52 of the filter element 50 is cantilever mounted and suspended over space 80 between the forward edge 92 of the support ledge 29 and the cylindrical end 25 of the forward housing section 24. The notches 68 and 70 are located adjacent to but slightly forward of the forward ends 92 of the shoulder 86. The portion of the wall 66 located forwardly of the notches 68 and 70 provide the rigidity needed to maintain the filter in horizontal position, as shown in FIG. 9.

Figure 10:
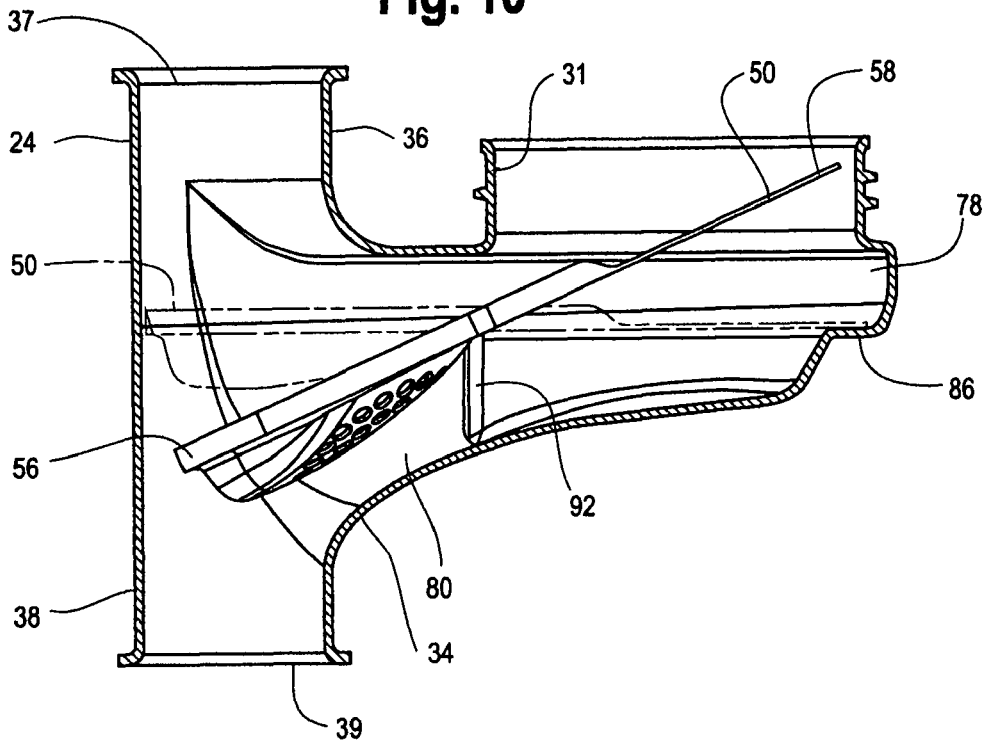
FIG. 10 is a sectional side view similar to that of FIG. 9 but with the filter element angled upwardly toward the access opening in position to be removed for cleaning or replacement, or to be reinstalled into the housing, and with the hatch cover removed.

Referring to FIGS. 9 and 10, one important advantage of this cantilever mounting of the filter forward part 52 of the filter element 50 is that it enables the filter element 50 to be tipped about an axis at the end 92 of the support ledge 29 from the horizontal position shown in broken line to the slanted position of the filter element 50 shown in solid line in FIG. 10. This pivoting ability which would be prevented, if there were underlying support, enables removal of the filter element 50 through the elevated hatch opening 31 at the top of collar 33. Advantageously, the relatively large size of the hatch opening 31 and the ability to pivot the filter element 50, enables removal with relatively little bending or other distortion of the filter element 50 that could damage the filter element 50. This pivot capability is also enabled by the configuration of the throat section 34 of the housing that creates the space 80 needed for receipt of the forward end of the filter element 50 when being pivoted.

Because the sides and back edges of the aft filtering portion 54 are in abutting relationship with the interior sidewalls of the aft section 26 of the housing 22 and the filter may be covered with debris during removal, the drain hole 62 advantageously enables an easy way of grasping the filter element 50 for removal. In accordance with one aspect of the invention, after the hatch cover 32 is fully removed, as shown in FIG. 9, the drain hole 62 is used as a finger grip, or handle, by hooking a finger though the access opening 62 and pulling upwardly. The aft end 58 of filter element 50 may then be easily lifted upwardly which pivots the forward end 56 to pivot downwardly, as shown in solid line in FIG. 10. With the filter element 50 in this tilted orientation, the filter element 50 may then be easily pulled laterally upwardly and out of the hatch opening 31 either by using the drain hole 62 or simply by grasping the end portion 58 after is made accessible by the initial lifting using the finger grip provided by the drain hole 62.

Figure 12:
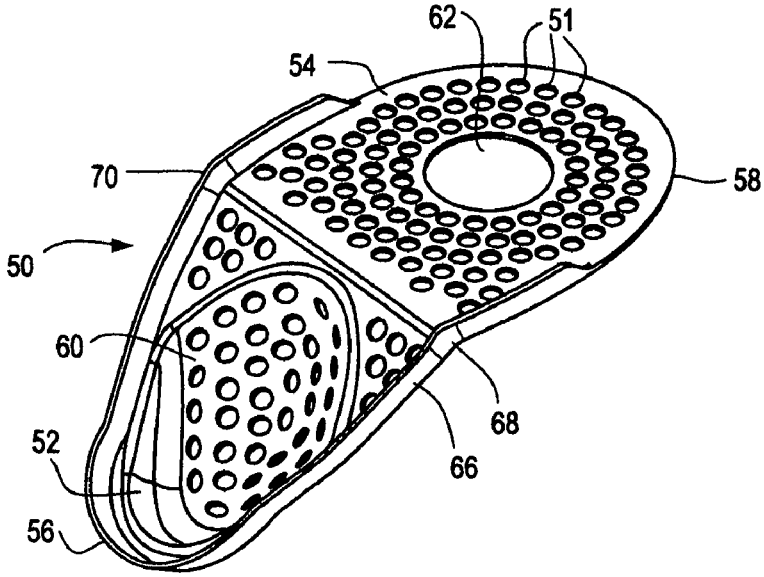
FIG. 12 is a perspective view of the filter element when in a bent configuration.

In keeping with another important aspect of the invention, it is possible to clear a clog in a drain located downstream of the drain filter apparatus 20 with a plumbing auger 96 or other like unclogging tool without having to first remove the filter element 50 from within the housing 22. Referring now to FIGS. 11 and 12, when the tool 96 is pushed downwardly though the inline, upstream drain pipe 40 (shown in FIG. 1) and into the inlet part 36 of the forward housing 24, the end of the tool (not shown) first engages the forward, concave primary filtering area 52. The concave filtering area 52 is normally in a fully blocking position between the inline inlet 37 and the outlet 39. The end of the tool 96 pushes the filter 50 away from this fully blocking position and pushes it downwardly to pivot the distal end portion 56 from the horizontal position, shown in broken line in FIG. 9, to a downward bent position slightly lower than the position shown in FIG. 11.

The distal end portion has an outwardly and upwardly slanted wall 74 to facilitate sliding movement of the tool 96 past the distal end 56 of the forward filter portion 52 after the portion 52 has been bent downwardly by the tool 96. The end of the tool 96 slides off and pushes past the distal end of the filter element 50, and the forward portion 52 of the filter then springs back upwardly to the position shown in FIG. 11. In this position the forward part 52 of the filter element 50 is moved away from the fully blocking position to allow passage of the tool 96 between the inlet 37 and the outlet 39. In this other position, the side of the tool 96 blocks resilient return of the forward filtering portion 52 to the operative horizontal blocking position in which filtering can occur. The tool 96 can then be passed though the inline outlet part 38, out of the outlet 39 and into the inline, downstream drain pipe 46 (shown in FIG. 1) to unclog the downstream drainage system.

When the tool 96 is removed the aft portion 52 of the filter element 50 automatically, resiliently returns to the horizontal position shown in FIG. 9.

As best seen in FIG. 12, the bending occurs along an imaginary hinge-line, or fold-line, 81 extending between the inwardly extending, notches 68 and 70 in the reinforcing wall 66. The distal end 56 of the forward portion 52 is partly received in and accommodated by the space 80 provided by throat-like wall section 34 and partly within the interior cylindrical space of the outlet part 38, FIG. 11. The aft portion 54 is held horizontally by the underlying support member 29 and the shoulder 86 behind the end 92 of the shoulder 86. The end 92 of the shoulder 86 is located directly behind and adjacent the notches 68 and 70 and is spaced from the distal end 56 of the filter element 50. The absence of any underlying support is, of course, what enables the bending of the end portion 56 relative to the aft portion 54 and the housing 22 during tool insertion.

Figure 13:
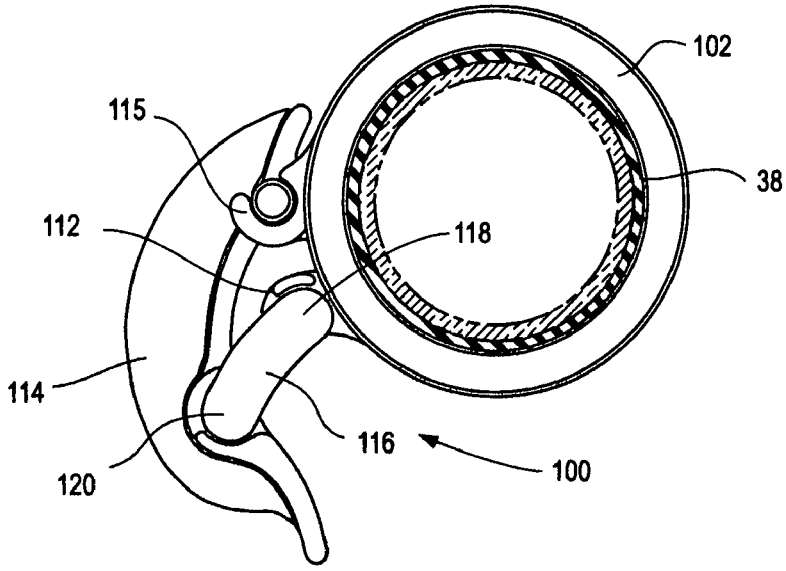
FIG. 13 is a plan view of one of the pair of identical clamp connectors preferably used to attach opposite ends of the inline section of the removable drain filter apparatus with the connector in an unlocked position.
Figure 14:
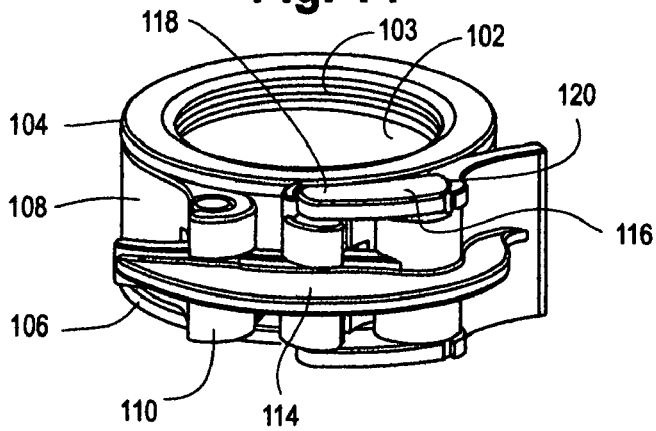
FIG. 14 is a perspective view of clamp connector of FIG. 13 but with the clamp in a locked position.
Figure 15:
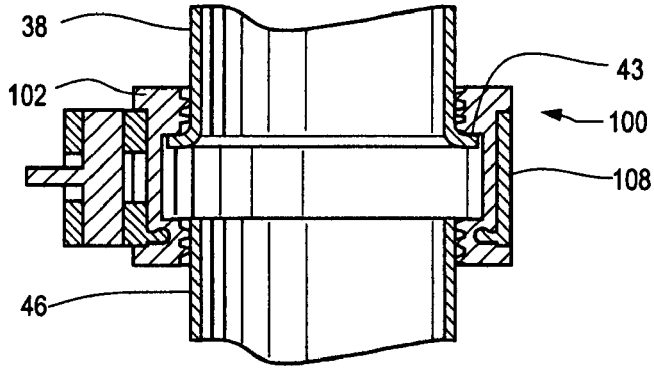
FIG. 15 is a sectional side view taken along section line 13-13 of the clamp connector of FIG. 14 shown as connected to an end of the drain pipe.

Turning now to FIGS. 13-15, the identical connectors 42 and 44 are preferably toggle-type clamps 100 that are easily used to enable the manual removal and installation of the drain filter apparatus 20 (or 20', below) in just a matter of seconds without the need for tools. In the case of retrofit installation of the drain filter apparatus, installation is preferably achieved in accordance with the invention without the need for cutting or replacement of any pipes, if the distance between the outlet and the inlet of the P-trap is approximately equal to the distance between the inlet 37 and the outlet 39 of the drain filter apparatus. In such case the inlet and outlet of the P-trap are reversed to compensate for the additional length being added to the drainage system by installation of the drain filter apparatus. The shorter of the two legs of the U-shaped, P-trap pipe is attached to the downstream outlet 39. In accordance with the invention, preferably the distance between inlet and the outlet is kept relatively small in order to be no greater than, and preferably equal to, the minimum standard distance between the opposite ends of a standard P-drain. In the event of the distance between the inlet and the outlet of the drain filter apparatus being less than the distance between the inlet and the outlet of the P-drain, then an extension pipe can be used to make up the difference that can be attached without the use of tools by using a clamp 100. If a pipe does need to be shortened, then an end portion may be sawed off and connected to an inlet or outlet of the drain filter apparatus though use of a clamp 100.

The clamps 100 have a resilient cylindrical sealing body 102 with a diameter slightly larger than the diameter of the drain pipes 40 and 46 and of the cylindrical inlet portion 36 and outlet portion 38 to be interconnected inline. As seen in FIG. 15, the end of the downstream pipe 46 and the outlet portion 38 of the housing section 24 are positioned together in end-to-end, inline, abutting relationship. The flanges 41 and 43 assist in making this alignment by providing a wider engagement surface for the plain end of the drain pipe. The sealing body 102 is fitted over the abutting ends and secured to create a watertight coupling.

The sealing body 102 is made of a water impervious, resilient, plastic-like or plastic material or rubber or rubber-like material, such as Dynaflex™ G7702-9001-02 (TPE) or EPDM. The sealing body 102 has a generally spool-lie shape with annular flanges 104 and 106 at the top and bottom within which is received a tightening band 108. The tightening band is preferably made of a relatively non-resilient plastic, such as 9012 High Density Polyethylene and has a hook 110 at one end and an axle receiving eyelet 112 at the opposite end. The hook 110 and the eyelet 112 face each other on one side of the resilient sealing body 102 and are engaged by a clamp mechanism including a toggle 114 and a pivot link 116.

The pivot link 116 has a pivot axle at one end 118 received within the eyelet 112 and another pivot axle at an opposite end 120 received within a mating bore in the toggle member 114 spaced from the hook 110 is pivotally mounted to rotate around the eyelet. The toggle member 114 has a post 111 that is received within the hook for relative rotation. When the post 111 is positioned within the hook 110 and the link, or lever, 118 rotated from the position shown in FIG. 13 to the locked position shown in FIG. 14, the band 108 is tightened about the cylindrical sealing body which is pressed in water tight sealed relationship against the abutting ends of the pipe 46 and the outlet portion 38, as shown in FIG. 15. The flange 41 assists in alignment of the ends and prevents the clamp 100 from falling off the end outlet end 38. Preferably, a plurality of internal ridges 103, FIG. 14, are provided within the interior of the sealing body 102 that are pressed against the sides of the drain pipe and outlet to assist in creating the watertight seal.

Turning now to FIGS. 16-22, another embodiment 20' of the drain filter apparatus of the present invention is shown in which corresponding parts have been given the same reference numerals as used in the previous drawings of the drain filter apparatus 20. Unless otherwise indicated, features given the same reference numeral generally perform some, if not all, the same functions as in the drain filter apparatus 20, unless otherwise indicated.

Figure 16:
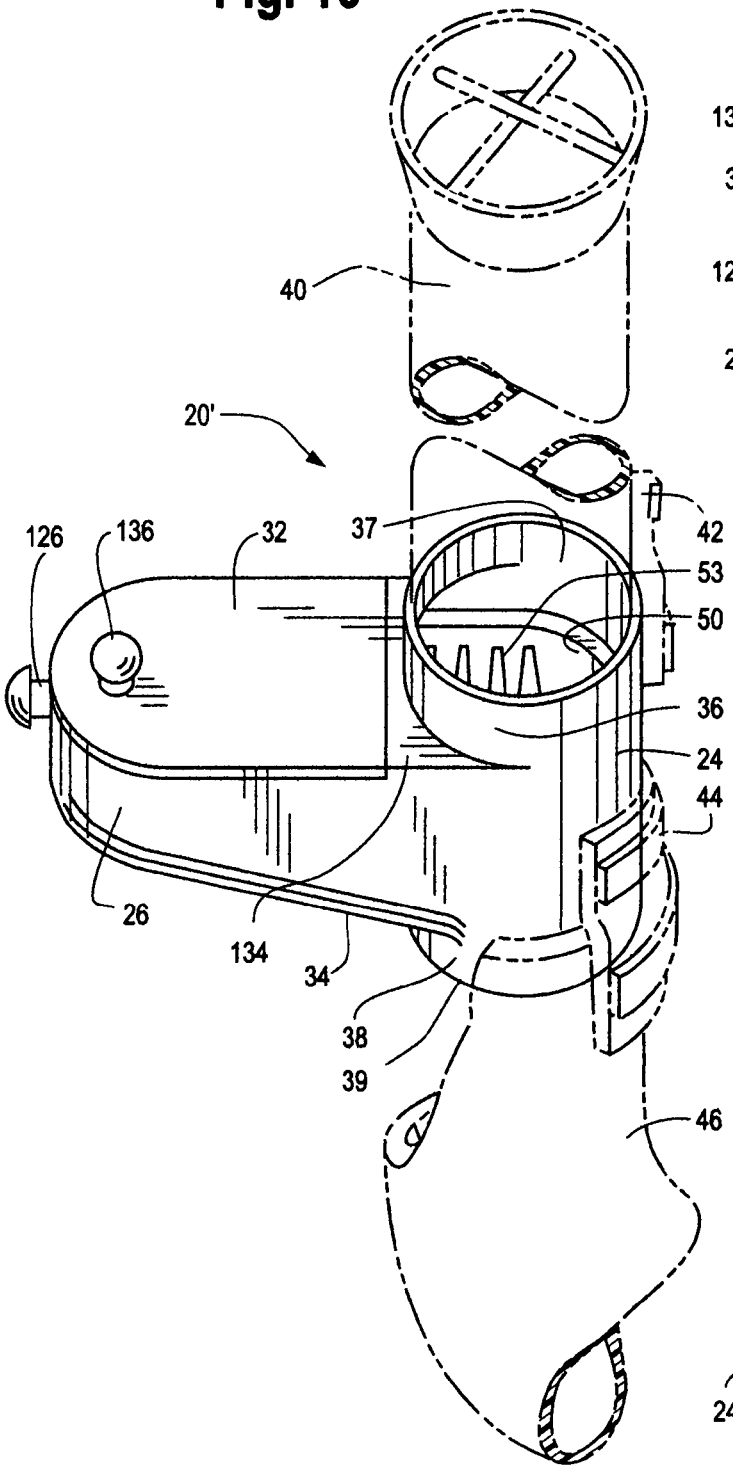
FIG. 16 is a perspective view of another embodiment of the removable drain filter apparatus.
Figure 17:
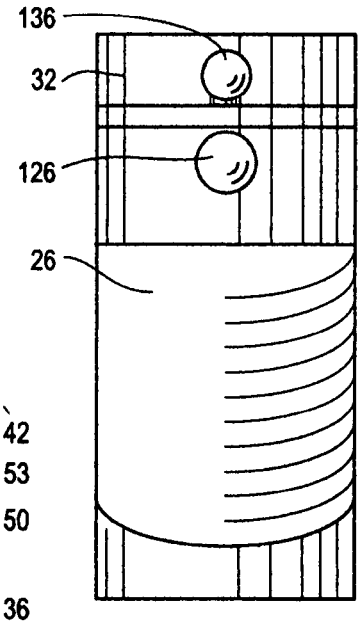
FIG. 17 is an aft end view of the embodiment of FIG. 16.
Figure 18:
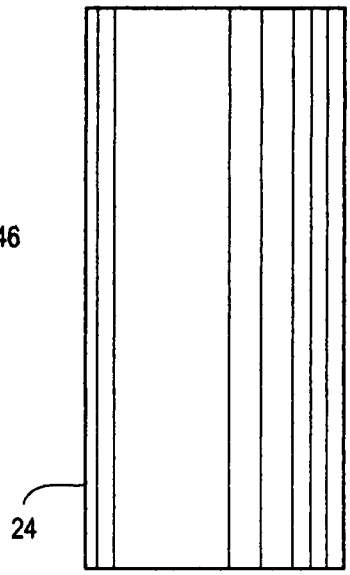
FIG. 18 is a forward end view of the embodiment of FIGS. 16 and 17.
Figure 19:
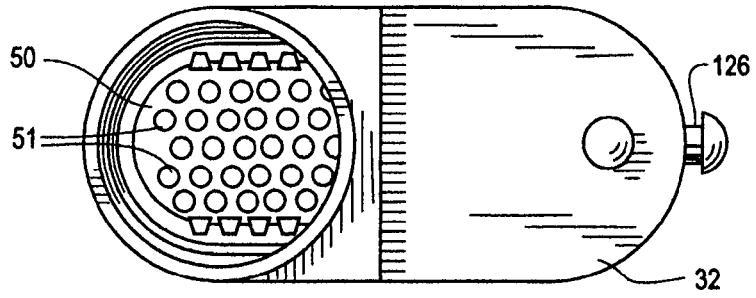
FIG. 19 is a plan view of the embodiment of FIGS. 16-18.
Figure 20:
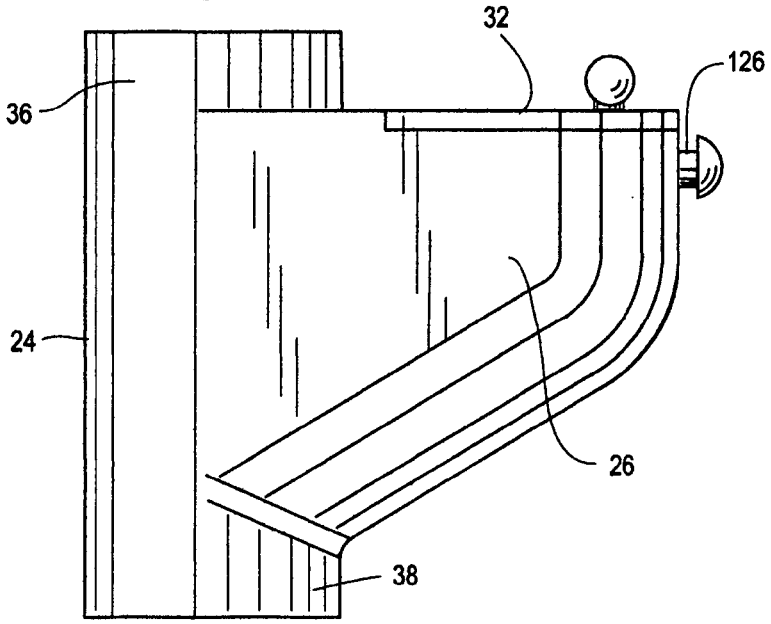
FIG. 20 is a side view of the embodiment of FIGS. 16-19.

As seen in FIG. 16, the drain filter apparatus 20', like apparatus 20, has a housing 22 with a cylindrical forward section 24 and an aft section 26 that extends laterally, radially outwardly from the forward section 24. A filter element 50 has a plurality of holes 51 as well as upstanding filter slots 53. The filter element is mounted upon a sled 122, FIG. 22, which, in turn, is mounted upon spaced-apart, parallel side rails 124. The sled 122 is removably mounted on the side rails 124 within the housing 22. The side rails 124 extend from the aft housing 26 directly beneath the upwardly facing access hatch opening 31 to the end of the forward housing 24.

During installation of the filter element 50, the sled 122 is located immediately beneath the hatch 31 and the filter element 50 is lowered through the hatch 31 into a nested relationship with the sled 122 and supported at its top by means of a peripheral mounting collar 123 resting on the top edge of the sled 122. Both the sled 122 and the filter 50 have an oval shape. The planer bottom of the filter element 50 has a plurality of relatively small filtering holes 51 and a peripheral side wall with a plurality of generally vertical filtering slots 53. A handle 55 facilitates handling of the filter element during installation and removal. After the filter element 50 is installed, the hatch opening is substantially elevated above the flat bottom with the plurality of filtering holes 51.

The filter 50 is installed by passing it though the hatch opening 31 after the hatch cover 32 is removed. The hatch cover 32 is then replaced to close the hatch 31 with a water tight sealing member carried by the side edge of the hatch cover 32 (not shown). The hatch is locked in place by means of a fixed latch member 132 that wedges beneath a mating lip 134 of the housing 22 and movable latch at the opposite end of the hatch cover 32 controlled by a rotatable latch handle 136, or a snap fit connector (not shown).

After the hatch cover 32 is locked into a watertight engagement with the hatch 31, the sled 120 along with the filter element 53 is moved into a filtering position pressed against the end cylindrical wall 27 of the forward housing section 24 and inline with the inlet and outlet. The aft part of the filter element 50 is also partly located in the aft portion of the housing 22. This movement of the filter element is accomplished by a pushing rod 126 that slides through a mating water-tight slide opening 128 from without the housing 22 and engages a mating tubular rod female connector 130 carried by the sled 122. Thus, there is no need to remove the hatch cover before drainage occurs.

Figure 21:
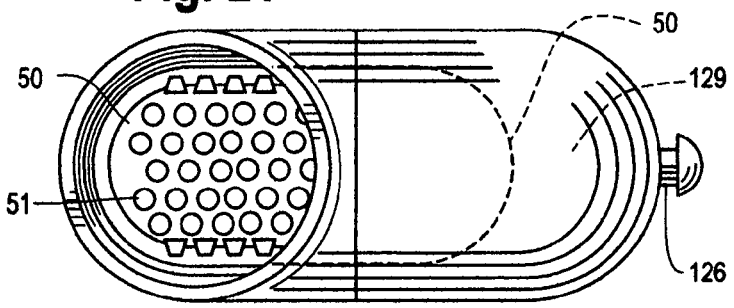
FIG. 21 is a bottom view of the embodiment of FIGS. 16-20.
Figure 22:
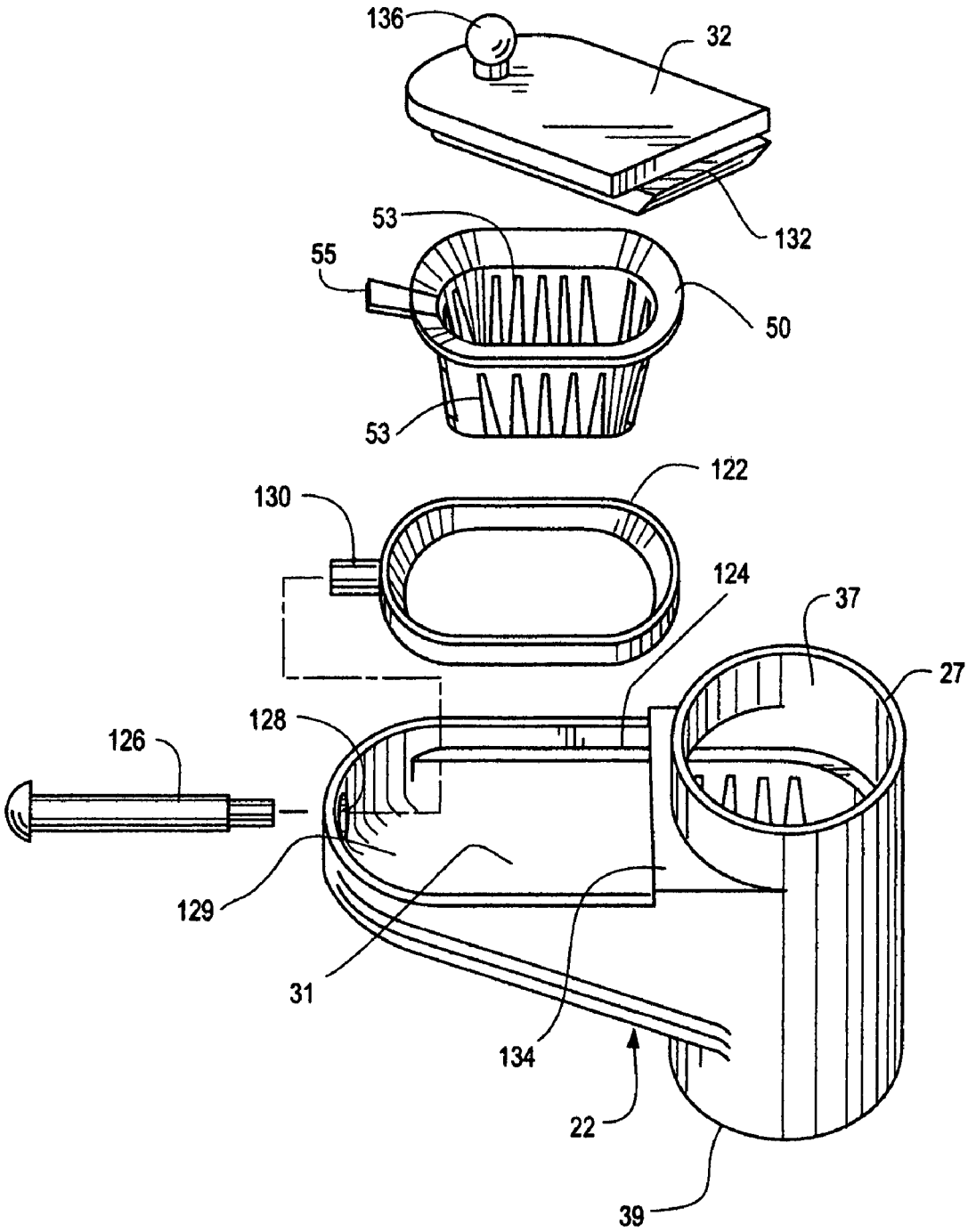
FIG. 22 is an exploded view of the embodiment of FIGS. 16-21.

Advantageously, when the filter element 50 after being pushed into filtering position with forward part of the filter element 50 located inline with the inlet 37 and outlet 39, a drain hole 129 is created aft of the filter 50 as best seen in FIG. 21. Once the drain filter element 50, which has a cup-shaped configuration, becomes clogged, water can pass over the debris within the filter element 50 and pass through the drain hole 128. Since the drain hole 128 is not in the filter element, itself, like drain hole 62, it is not necessary to plug the drain hole 128. Unlike the known basket-like filtering elements that fill the entire housing without leaving an aft-located, open drain hole, clogging, as well as spillage occurring when the hatch cover 32 is removed, are avoided. Also, if it is believed that the drainage is not sufficient with the filter 50 in a blocking position, then the filter 50 is slidably moved away from the inline blocking position to allow inline drainage directly through the outlet 39 created by such rearward movement of the filter element 50.

Thus, although the filter 50 of this embodiment 20 is not bendable, it is movable to achieve similar goals similar to those achieved by bending the filter. While the filter is not wider than the drain pipes as in embodiment 20, it should be appreciated that a wider body for the filter and filter housing could be employed as in the embodiment 20.

Another advantage derived from the slidably movable filter element 50 is that if it is desired to pass an unclogging tool through the drain pipes, the tool can be passed though the drain filter apparatus 20' without removing the filter element 50 or opening the hatch 32. This movement is achieved by using the rod 126 to manually pull the sled 122 into the aft section 26 of the housing 22 to remove the forward end of the filter away from a blocking position between the inlet 37 and the outlet 39 of the forward section 24 of the housing 22. After the filtering tool is removed from within the housing section 24, the filter element 50 is pushed back into the blocking filtering position between the inlet 37 and the outlet 39.

In order to remove the filter element 50 from the housing 22, the hatch cover is unlocked and then removed, the sled is pulled to the aft position beneath the hatch 31 and the hand 55 is used to lift the filter element out of engagement with the sled 122 and out of the hatch 31.

It should be appreciated that if it is desired, the hatch cover 32 of the second embodiment 20' of the drain filter apparatus could be provided with a downwardly extending closure member to plug or otherwise close the open drain 129, FIG. 21, created behind the filter element 50 when in filtering position, if it is desired to have the drain filter apparatus to clog to provide an indication of need to clean the filter element 50

Thus, this invention contemplates methods of filtering and of achieving the objectives of the invention that may employ all or some of the features of both or either one of the two drain filtering apparatus embodiments 20 and 20', disclosed above.

Thus, in accordance with the present invention a method of filtering drain liquid with a drain filter apparatus is provided that includes performance of the steps of: (1) connecting a filter housing with a watertight filtering chamber between a pair of drain pipes, (2) installing a filter element with a plurality of filtering holes within the watertight filtering chamber by inserting the filter element through an access hatch in the chamber, (3) closing the hatch with a removable watertight hatch cover for closing the access hatch opening, (4) passing liquid from one of the drain pipes through the filter element until the filter element becomes clogged, (5) draining any water collected above the filter element through a drain hole that bypasses the plurality of filtering holes while the hatch is still at least partly closed, (6) removing the hatch cover after the filtering chamber has been drained through, and replacing the clogged filter element with a clean filter element installed into the filtering chamber, and (7) re-closing the hatch to resume filtering with the clean filter element.

This filtering method preferably includes one or more of the steps of (8) closing the drain hole during normal filtering operations when the hatch is closed, (9) opening the drain hole during opening of the hatch cover when the hatch is at least partly closed, (10) closing the drain hole during normal filtering operations with a tapered plug carried by the hatch cover, and (11) maintaining a watertight seal with a seal that is positioned relative to the drain hole and the closure member to remain in watertight sealed contact with the access hatch until after the closure member is at least partly removed from the drain hole to allow the filtering chamber to drain.

The object of the invention is also obtained by providing a method of filtering with a filter apparatus by performing the steps of (a) passing waste water through opposite ends of an inline section of a watertight housing connected between an upstream drain pipe and a downstream drain pipe, (b) filtering the waste water with a filter body having a filtering portion located in a blocking position between the opposite ends, (c) moving the filtering portion out of the blocking position while the housing remains watertight, (d) passing an unclogging tool through the opposite ends to clear a clog in the downstream pipe when the filtering portion is removed from a blocking position, (e) withdrawing the tool from the housing after the clog has been removed, and (f) returning the filtering portion to the blocking position for further filtering.

Preferably, the step of moving the distal end portion includes the step of either bending the filtering portion downwardly with the unclogging tool, or sliding the filter away from a blocking position.

Also, preferably, in the case of the first embodiment 20, the method includes the steps of bending the filtering portion downwardly with the unclogging tool until it is removed from the blocking position, holding the filtering portion out of a fully blocking position with a side of the unclogging tool after the tool has been fully passed between the inlet and the outlet, and resiliently returning the distal end portion of the filter element to the fully blocking position after the tool has been removed from within the housing.

For reasons previously discussed, when practicing this method preferably the drain hole closure is a plug with an inwardly tapered configuration, such as a truncated cone to facilitate a snug fit within the drain hole when fully inserted and to partially open the drain hole when the plug is partly removed. Alternatively, the drain hole member is merely a flat member that merely cover the drain hole but does not actually extend into the hole.

It should be appreciated that the drain hole does not necessarily have to be located in the filter element but could also be a bypass formed integrally with the housing 22 such as shown and described above with respect to the second embodiment 20' described above with respect to FIGS. 16-22.

Preferably, the above method includes the steps of maintaining a watertight seal between the hatch and the hatch cover with a seal that is positioned relative to the drain hole and the drain hole closure member so that the drain hole becomes at least partly unclosed by the drain hole closure member while the seal is in sealing engagement with the hatch. In the case of the use of a plug, the plug is at least partly, if not entirely, removed from a closure position with respect to the drain hole to allow the filtering chamber to drain.

Preferably, the access hatch cover is threadably attached to the hatch, closing of the filter drain hole is performed by locating the filter drain hole beneath the access hatch opening, and lowering the plug into the drain hole when the hatch cover is screwed into a fully closed position.

Moreover, the present invention contemplates another method of filtering a drain with a filtering apparatus by performing the steps of: (1) connecting an inlet and an outlet at opposite ends of an inline section of a watertight housing with an upstream drain pipe and a downstream drain pipe, respectively, said housing having an inline section in fluid communication and another section laterally extending outwardly from the inline section; (2) cantilever mounting, or otherwise mounting, a filter element cantilever within the housing to enable movement of a distal end portion of the filter element between a fully blocking position between the inlet and the outlet and another position in which a part of the filter element is moved away from a fully blocking position, and (3) after the filter element is moved from a blocking position, passing an unclogging tool between the inlet and the outlet to push the distal end portion out of fully blocking position in order to clear a clog located downstream of the housing.

Preferably, this other method includes the step of bending the distal portion downwardly with the unclogging tool. Preferably, the filter element has a peripheral wall with a pair of inwardly extending notches on opposite sides of the of the filter element, and the filter element is bent generally along a line extending between the inwardly extending notches when the distal end portion is pushed out of a fully blocking position, but the method contemplates that such bending could occur without the necessity of such a stiffening wall such as if the filter body were sufficiently stiff without the wall to maintain a horizontal orientation during normal filtering and only bending when forced to by an unclogging tool.

In any event, preferably, this method includes the steps of holding the distal end portion out of a fully blocking position with a side of the unclogging tool after the tool has been fully passed between the inlet and the outlet, removing the unclogging tool, and resiliently returning the distal end portion of the filter element to the fully blocking position after the tool has been removed. Thus, the filter does not have to be either removed before the unclogging operation or returned to a filtering position after the unclogging procedure is completed.

The invention also provides a method of filtering with a drain filter apparatus by performing the steps of (1) releasably mounted a filter element with a preselected filtering area at an intermediated location within a watertight filtering chamber to divide the chamber into an upstream part having a top and a downstream part with a bottom, (2) connecting an upstream drain pipe to the upstream part of the chamber, (3) connecting a downstream drain pipe to the downstream part of the chamber, (4) locating a closable, upwardly facing, access hatch only in the top of the upstream part of the chamber for access to the filter element for removal and installation of the filter element, (5) after the filer element becomes clogged, draining water out of the filtering chamber past the filtering area before fully opening the closable hatch, (5) fully opening said closable access hatch after the filtering chamber has been drained, and (6) removing the filtering element from the chamber by pulling it upwardly though the hatch.

Preferably, the step of draining includes the step of draining includes the step of draining through a drain hole in the filter while the closable access hatch is at least partly closed.

Also, preferably, the method includes one or more of the steps of (8) partly draining the upstream part of the chamber through a drain hole while the closable access hatch is at least partly closed, (9) pulling a plug from plugging relationship with the drain hole while the hatch cover is being removed from a closed relationship with the closable hatch but before being fully removed, (10) The hatch cover carries a central core with a seal, and the method also may include the step of maintaining a sealed relationship of a central core with a seal carried by the hatch cover with the access hatch when the plug is only partly removed from closed relationship with the drain hole. While the drain hole in the present embodiment of the filter apparatus is in the filter element itself, the method contemplates that the drain hole could be part of the housing instead of the filter to provide more filtering area that would otherwise be taken by the drain hole.

While particular embodiments and associated methods have been shown and described in detail it should be appreciated that many changes can be made to these details without departing from the spirit and scope of the invention. For instance, while the hatch cover in embodiment 20 is threadably fastened to the hatch opening, it should be appreciated that the cover could be fastened by any other suitable fastening technique, such as a rotary lock, a resilient snap fit, a clamp, etc. Likewise, while one aspect of the invention contemplates that the filter element will have both an inline portion and a laterally removed portion, the aspect of the invention relating to bending the filter element out of the way of an unclogging tool does not require the lateral section of the filter, wall with notches, etc. as there are many other ways pursuant to which a filter may be mounted for flap-like movement without the need for a lateral portion, such as a spring loaded hinge to which the filter element is releasably attached, etc. Likewise, this and other aspects of the invention do not necessarily require a drain hole or a plug. The drain hole does not necessarily have to be in the filter element but can be a bypass built into the housing. The drain hole does not have to be closed by a plug but can be closed by a simple flat closure carried by the hatch cover or otherwise. The drain hole may be always open and may be moved out of blocking relationship by sliding, as shown and described with reference to the second embodiment 22. Of course, instead of cleaning the filter element after it becomes clogged, the filter could be made of less durable and thus cheaper material and simply discarded after it becomes clogged and replaced with another new filter that has never before been used. While a drain hole that is larger than the filtering holes is preferred, the drain hole could simply be an area covered with filtering holes that are kept covered during normal filtering operation in the same way that the drain hole 62 is kept covered. Functional equivalents will occur to persons of ordinary skill in the art. Reference should therefore be made to the appended claims.

The invention claimed is:

1. A drain filter apparatus, comprising:

a filter housing with a watertight filtering chamber having a forward, cylindrical section and a relatively wider and larger aft section extending laterally outwardly from the forward cylindrical section and having a top and a bottom;

means for connecting an upstream drain pipe to the top of the forward cylindrical section of the watertight filtering chamber;

means for connecting a downstream drain pipe to the bottom of bottom of the forward cylindrical section of the filter housing; and a filter element mounted at an intermediate location within the chamber and extending coextensively with both the forward section and aft section of the filtering chamber and sealed against interior walls of the filtering chamber to divide the chamber into an upstream part above the filter element and a downstream part beneath the filter element, said filter element having a generally planer filter body with a forward, relatively narrow, primary filtering portion within the forward cylindrical section and located directly beneath the upstream drain pipe connecting means, and an aft, relatively wider, secondary filtering portion within the aft section of the filtering chamber and extending laterally outwardly from the relatively narrow primary filtering portion with a width and a cross-sectional area that is substantially larger than the diameter and cross-sectional area of the forward portion of the filter element, of the forward section of the cylindrical filtering section and of the upstream drain pipe.

2. The drain filter apparatus of claim 1 including a closable, upwardly facing, filter access hatch in the upstream, forward part of the chamber for access to the filter element, said filter access hatch having a width and cross-sectional area substantially larger than that of the upstream drain pipe to enable removal of the filter element though the access hatch without substantial distortion of the filter element.

3. The drain filter apparatus of claim 1 in which the aft portion of the filter body has a handle opening sufficiently large to enable a person to insert their finger through the hole to pull the aft portion out of the access hatch opening.

4. The drain filter apparatus of claim 1 in which the filter element has a filtering area that is at least three times larger than the cross-section of the drain pipes.

5. The drain filter apparatus of claim 1 in which the aft portion of the filter element is substantially planer, but the primary filtering has a concave portion with a plurality of filtering holes located only generally intermediate the drain pipe connecting means.

6. The drain filter apparatus of claim 1 including an upwardly facing access hatch opening located at the top of an upstanding collar, said upstanding collar extending upwardly from a top of the upstream part of the filtering chamber that is entirely elevated above the filter element.

7. The drain filter apparatus of claim 1 including means for squeezing the top and bottom of the aft peripheral portion of the filter body between two members that are mounted for vertical movement relative to each other.

8. The drain filter apparatus of claim 1 in which the planer filter body is at least one of (a) relatively flexible compared to the housing and drain pipes and (b) bendable.

9. The drain filter of claim 1 in which the connecting means are manually operable toggle clamps with resilient seals.

10. The drain filter apparatus of claim 1 including
an upwardly facing access hatch located entirely above the filter element for access to the filter element, and
a releasable watertight hatch cover.

11. A drain filter apparatus, comprising:
a filter housing having a watertight filtering chamber;
a filter element mounted within the watertight filtering chamber with an inlet and an outlet and having
a plurality of filtering openings through which drain water may pass, and
a closable drain hole for draining water from the filtering chamber when the plurality of filtering elements become clogged; and
an access hatch in the chamber for access to the filter element for removal and installation of the filter element; and
a removable watertight hatch cover for closing the access hatch opening and carrying a drain hole plug for selectively closing the closable drain hole.

12. The drain filter apparatus of claim 11 in which the drain hole plug
closes the drain hole when the hatch cover is in a fully closed position, and
is removed at least partly from the drain hole when the hatch cover is in less than a fully closed position but which is still watertight.

13. The drain filter apparatus of claim 11 in which
the drain hole plug includes
a tapered plug body that extends downwardly from an underside of the hatch cover
that is received within and fills the drain hole when hatch cover is fully closed, and
that is at least partly removed from the drain hole when the hatch cover is moved to a position less than fully closed.

14. The drain filter apparatus of claim 11 in which
the watertight cover has a watertight seal that is positioned relative to the drain hole, and
the plug to remains in watertight sealed contact with the access hatch until after the plug is at least partly removed from the drain hole to allow the filtering chamber to drain.

15. The drain filter apparatus of claim 14 in which the
hatch cover includes a centrally inwardly located, downwardly extending, closure member with a circular groove snuggly received within the access hatch, and
the seal is an O-ring that is seated within the circular groove.

16. The drain filter apparatus of claim 11 in which
the access hatch is a circular opening in the filter housing, and
the hatch cover is secured to the access hatch opening by rotating the hatch cover into a locked, sealed relationship with the hatch opening.

17. The drain filter apparatus of claim 15 in which
the access hatch cover is threadably attached to the hatch cover,
the filter drain hole is located directly beneath the access hatch opening, and
the drain hole plug is lowered into the drain hole when the hatch cover is screwed into a fully closed position.

18. The drain apparatus of claim 11 in which the hatch cover includes
a hatch cover body with a cylindrical wall with internal threads,
a downwardly extending closure member with an upper cylindrical section that is concentric with and spaced radially inwardly from the cylindrical wall and has a groove within which is mounted a resilient seal, and
a lower, section with
a bottom with a periphery and carrying the -drain hole plug at a central inner location extending downwardly from the bottom and spaced from a periphery of the bottom to define a shoulder,
said shoulder pressing down on the filter element when the plug fills the filter drain hole.

19. The drain filter apparatus of claim 18 in which
the downwardly extending filter securement member is made from hollow resilient plastic, and
has a radially, outwardly extending, connection collar for resilient locking engagement between a snap-fit connector tab and an underside of the hatch cover.

20. The drain filter apparatus of claim 11 in which the drain hole is at least one of (a) larger in area size than each of the plurality of filtering holes, (b) approximately six-eighths of an inch in diameter, and (b) approximately six times larger in area size than the plurality of filtering holes.

21. A filter apparatus, comprising:
a watertight housing with
an inline section with an inlet and an outlet at opposite ends for connection with an upstream drain pipe and a downstream drain pipe, respectively;
a lateral section in fluid communication with, and laterally extending outwardly from, the inline section;
a filter element mounted within the housing to enable movement of a distal end portion of the filter element between
a fully blocking position between the inlet and the outlet, and
another position in which a part of the filter element is moved away from a fully blocking position to allow passage of an unclogging tool between the inlet and the outlet.

22. The drain filter apparatus of claim 21 in which the filter element has a peripheral wall with a pair of inwardly extending notches on opposite sides of the of the filter element to facilitate bending of the filter element along a line extending between the inwardly extending notches.

23. The drain filter apparatus of claim 21 in which the lateral section has a space located beneath the distal end portion to accommodate receipt of the end portion when moved downwardly to the other position.

24. The drain filter apparatus of claim 21 in which the distal end portion has an outwardly and upwardly slanted wall to facilitate sliding movement of a tool past the distal end as the distal end portion is bent downwardly by the tool.

25. The drain filter apparatus of claim 21 in which the filter element has an aft portion located opposite the distal end portion with opposite sides that are supported by a pair of underlying opposite mounting members with forward ends that are spaced from the distal end portion, said distal end portion being cantilever mounted with no underlying support to enable it to be bent downwardly relative to the distal portion during tools insertion.

26. A drain filter apparatus, comprising:

a filter housing with a filtering chamber and an access opening to the filtering chamber;

a releasably mounted filter element with a surface resting on an underlying filter support member within the filtering chamber; and a removable cover for closing the access opening, said cover carrying a filter securement member that extends inwardly from the access opening into the chamber and engages a surface of the filter element opposite to said one surface when in a fully closed position, said filter element being held in place between the support member and the securement member; and in which the securement member has a filter engagement surface from which extends an inwardly located, downwardly extending plug that is received within a mating hole in the filter element when the engagement surface of the securement member engages the filter element, location of said plug within the mating hole blocking relative lateral movement, and the engagement surface and the filter support member block relative vertical movement of the filter element.

27. The drain filter apparatus of claim 26 in which the underlying support member is elongate and supports the filter element only along a peripheral edge of one end portion of the filter element, and said filter element has an opposite end portion with an upstanding peripheral wall to provide enhanced rigidity of the opposite end portion for cantilevered support without underlying support.

28. A drain filter apparatus, comprising:

a filter housing having a watertight filtering chamber with an inlet and an outlet;

a filter element with a preselected filtering area releasably mounted at a location between the inlet and the outlet within the chamber and dividing the chamber into an upstream part having a top with the inlet and a downstream part with a bottom with the outlet;

means for connecting an upstream drain pipe the inlet of the upstream part of the chamber;

means for connecting a downstream drain pipe to the outlet of the downstream part of the chamber; and a closable access hatch for access to the filter element for removal and installation of the filter element, said closable access hatch being located only in the top of the upstream part of the filtering chamber and facing upwardly to reduce spillage when the access hatch is opened.

29. The drain filter apparatus of claim 28 including a closable drain hole in the filter element for draining water from the filtering chamber when the filtering area becomes clogged, and means for draining the upstream part of the chamber through the drain hole while the closable access hatch is at least partly closed.

30. The drain filter apparatus of claim 29 in which the closable hatch is closed by a hatch cover that carries a closure member for closing the drain hole, and said drain hole closure member being moved from closure relationship with the drain hole while the hatch cover is being removed from a closed relationship with the closable hatch.

31. The drain filter apparatus of claim 30 in which the hatch cover carries a central core with a seal that remains in sealed relationship with the access hatch when the closure member is removed from closed relationship with the drain hole.

32. The drain filter apparatus of claim 28 in which the closable access hatch is at the top of a collar elevated above the top to reduce spillage when the closable access hatch is opened.

33. A drain filter apparatus, comprising:

a filter housing with a filtering chamber, an inlet, an outlet and connectors for connecting the inlet and the outlet to upstream and downstream drain pipes, respectively;

a filter body within the chamber in filtering relationship between the inlet and outlet said filter body having a plurality of filtering holes extending through the filter body and located at one end portion of the filter body for passage of water to be filtered during filtering, and a drain hole extending through the filter body and located at another end of the filter body opposite the one end, said drain hole being larger than any of the filtering holes for draining the filtering chamber when the filtering holes become clogged; and a plug removably mounted to the filter body and receivable within the drain hole to block passage of water when the filter holes are not clogged.

34. The drain filter apparatus of claim 33 in which the filter body is substantially planer.

35. The drain filter apparatus of claim 33 in which the filter body has a generally oblong arcuate shape that is substantially wider than the drain pipes.

36. The drain filter apparatus of claim 33 in which the filter body has a convex portion at the one end portion.

37. The drain filter apparatus of claim 33 in which the filter body is substantially planer, and includes a peripheral wall surrounding only part of the filter body to increase rigidity of said part.

38. The drain filter apparatus of claim 33 in which the filter element has a peripheral wall surrounding part of the filter body with a pair of notches on opposite sides of the filter body to facilitate bending of the filter body along a line extending between the pair of notches.

39. A drain filter apparatus, comprising:

a filter housing with a filtering chamber, an inlet, an outlet and connectors for connecting the inlet and the outlet to upstream and downstream drain pipes, respectively;

a filter element contained within the housing and having a primary filtering section with a concave portion with a plurality of filtering holes and a periphery partly shaped to conform to an interior of a drain pipe conforming surface of the filtering chamber extending between the drain pipes; and an aft, substantially planer and relatively larger secondary filtering section with a plurality of filtering holes extending from the primary filtering section for filtering after the forward section becomes clogged.

40. The drain filter apparatus of claim 39 in which the aft filtering section has a drain hole, and including means for closing the drain hole during filtering and unplugging the drain hole when the filter becomes clogged.

41. The drain filter apparatus of claim 40 in which the drain hole is substantially larger than the plurality of filtering holes.

42. The drain filter apparatus of claim 40 in which the primary filtering section is cantilever mourned over an underlying open space to enable bending of the primary filtering section into the underlying open space and away from a blocking location between the inlet and the outlet.

43. A filter apparatus, comprising:

a filter housing with a filtering chamber, an inlet, an outlet and connectors for connecting the inlet and the outlet to upstream and downstream drain pipes; and a filter element contained within the housing and having a generally planer filter body with a plurality of filtering holes with a forward section and an aft section, a pre-weakened area of the filter body to facilitate relative bending between the forward section and the aft section.

44. The rain filter apparatus of claim 43 including an upstanding peripheral wall surrounding at least part of the forward section, and in which the a pre-weakened area is formed by a pair of notches in the in the upstanding peripheral wall.

45. The drain filter apparatus of claim 44 in which the peripheral wall surrounds the entire forward section.

46. The drain filter apparatus of claim 43 in which the filter housing has a filter support ledge that provides underlying support for a part of the aft section that has no peripheral wall.

47. The drain filter apparatus of claim 43 in which the forward portion of filter is cantilever mounted between the inlet and the outlet without underlying support to enable the forward portion to be bent at an angle relative to the aft section.

48. The drain filter of claim 43 in which the filter element has a generally oval shape.

49. A method of filtering drain liquid with a drain filter apparatus, comprising the steps of:

connecting a filter housing with a watertight filtering chamber between a pair of drain pipes;

installing a filter element with a plurality of filtering holes within the watertight filtering chamber by inserting the filter element through an access hatch in the chamber;

closing the hatch with a removable watertight hatch cover for closing the access hatch opening, passing liquid from one of the drain pipes through the filter element until the filter element becomes clogged;

draining any water collected above the filter element through a drain hole that bypasses the plurality of filtering holes while the hatch is still at least partly closed;

removing the hatch cover after the filtering chamber has been drained through; and replacing the clogged filter element with a clean filter element installed into the filtering chamber;

re-closing the hatch to resume filtering with the clean filter element.

50. The method of claim 49 including the step of closing the drain hole during normal filtering operations when the hatch is closed.

51. The method of claim 49 including the step of opening the drain hole during opening of the hatch cover when the hatch is at least partly closed.

52. The method of claim 49 including the step of closing the drain hole during normal filtering operations with a tapered plug carried by the hatch cover.

53. The method of claim 52 including, the step of maintaining a watertight seal with a seal that is positioned relative to the drain hole and the closure member to remain in watertight sealed contact with the access hatch until after the closure member is at least partly removed from the drain hole to allow the filtering chamber to drain.

54. A method of filtering with a filter apparatus, comprising the steps of:

passing waste water through opposite ends of an inline section of a watertight housing connected between an upstream drain pipe and a downstream drain pipe, filtering the waste water with a filter body having a filtering portion located in a blocking position between the opposite ends;

moving the filtering portion out of the blocking position while the housing remains watertight;

passing an unclogging tool through the opposite ends to clear a clog in the downstream pipe when the filtering portion is removed from a blocking position;

withdrawing the tool from the housing after the clog has been removed; and returning the filtering portion to the blocking position for further filtering.

55. The method of claim 54 in which the step of moving the distal end portion includes the step of either (a) bending the filtering portion downwardly with the unclogging tool, or (b) sliding the filter away from a blocking position.

56. The method of claim 54 including the steps of bending the filtering portion downwardly with the unclogging tool until it is removed from the blocking position, holding the filtering portion out of a fully blocking position with a side of the unclogging tool after the tool has been fully passed between the inlet and the outlet, and resiliently returning the distal end portion of the filter element to the fully blocking position after the tool has been removed from within the housing.

* * * * *